US007187878B2

(12) United States Patent
Izawa et al.

(10) Patent No.: US 7,187,878 B2
(45) Date of Patent: Mar. 6, 2007

(54) IMAGE FORMING APPARATUS AND ITS CONTROL METHOD

(75) Inventors: Satoru Izawa, Sunto-gun (JP); Koji Nihonyanagi, Susono (JP); Yutaka Kubochi, Mishima (JP); Fumiki Inui, Mishima (JP); Shinji Hashiguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/060,678

(22) Filed: Feb. 18, 2005

(65) Prior Publication Data

US 2005/0191070 A1 Sep. 1, 2005

(30) Foreign Application Priority Data

Feb. 27, 2004 (JP) ..... 2004-054638

(51) Int. Cl.
*G03G 15/00* (2006.01)

(52) U.S. Cl. ..... 399/44; 399/69

(58) Field of Classification Search ..... 399/44, 399/69, 337
See application file for complete search history.

(56) References Cited

U.S. PATENT DOCUMENTS

| | | | | |
|---|---|---|---|---|
| 5,083,168 | A | 1/1992 | Kusaka et al. | 355/285 |
| 5,138,379 | A * | 8/1992 | Kanazashi | 399/44 |
| 5,149,941 | A | 9/1992 | Hirabayashi et al. | 219/216 |
| 5,162,634 | A | 11/1992 | Kusaka et al. | 219/216 |
| 5,210,579 | A | 5/1993 | Setoriyama et al. | 355/285 |
| 5,221,682 | A | 6/1993 | Effland et al. | 514/349 |
| 5,262,834 | A | 11/1993 | Kusaka et al. | 355/285 |
| 5,300,997 | A | 4/1994 | Hirabayashi et al. | 355/285 |
| 5,343,280 | A | 8/1994 | Hirabayashi et al. | 255/285 |
| 5,450,181 | A | 9/1995 | Tsukida et al. | 355/282 |
| 5,525,775 | A | 6/1996 | Setoriyama et al. | 219/216 |
| 5,722,026 | A | 2/1998 | Goto et al. | 399/333 |
| 5,767,484 | A | 6/1998 | Hirabayashi et al. | 219/216 |
| 5,860,051 | A | 1/1999 | Goto et al. | 399/529 |
| 5,862,435 | A | 1/1999 | Suzuki et al. | 399/68 |
| 5,920,757 | A | 7/1999 | Izawa et al. | 399/329 |
| 5,960,233 | A | 9/1999 | Goto et al. | 399/69 |
| 6,298,213 | B1 | 10/2001 | Miyamoto et al. | 399/320 |
| 6,314,252 | B1 * | 11/2001 | Matsumoto | 399/45 |

(Continued)

FOREIGN PATENT DOCUMENTS

| | | |
|---|---|---|
| JP | 63-313182 | 12/1988 |

(Continued)

*Primary Examiner*—David M. Gray
*Assistant Examiner*—Bryan Ready
(74) *Attorney, Agent, or Firm*—Fitzpatrick, Cella, Harper & Scinto

(57) ABSTRACT

In continuous printing operation which repeatedly sets a state in which when a preceding printing material passes through the nip area of a thermal fixing unit, a succeeding printing material has been supplied to an image forming unit and image forming operation has been started, a first temperature indicating an ambient temperature near the thermal fixing unit is measured at an early time point in the continuous printing operation. A second temperature indicating the temperature of the printing material which has passed through the press contact nip portion at a predetermined period of time during the continuous printing operation is measured. The amount of heat to be supplied to the succeeding printing material is controlled on the basis of the measured first and second temperatures.

14 Claims, 24 Drawing Sheets

U.S. PATENT DOCUMENTS

| | | | | |
|---|---|---|---|---|
| 6,404,998 | B1 | 6/2002 | Tanaka et al. | 399/66 |
| 6,493,521 | B2 * | 12/2002 | Miyamoto et al. | 399/44 |
| 6,519,426 | B2 * | 2/2003 | Goto et al. | 399/69 |
| 6,671,488 | B2 | 12/2003 | Izawa et al. | 399/329 |
| 6,701,102 | B2 * | 3/2004 | Hasegawa et al. | 399/69 |
| 6,713,725 | B2 | 3/2004 | Izawa et al. | 219/216 |
| 6,748,192 | B2 | 6/2004 | Izawa et al. | 399/329 |
| 6,763,205 | B2 | 7/2004 | Izawa et al. | 399/69 |
| 6,787,737 | B2 | 9/2004 | Uekawa et al. | 219/216 |
| 6,794,611 | B2 | 9/2004 | Kataoka et al. | 219/216 |
| 6,862,416 | B2 | 3/2005 | Hashiguchi et al. | 399/69 |
| 2002/0159785 | A1 * | 10/2002 | Masuda et al. | 399/69 |
| 2003/0206756 | A1 | 11/2003 | Kanamori et al. | 399/328 |
| 2004/0037579 | A1 | 2/2004 | Hashiguchi et al. | 399/67 |
| 2004/0042827 | A1 | 3/2004 | Izawa et al. | 399/328 |
| 2004/0091279 | A1 | 5/2004 | Izawa et al. | 399/67 |
| 2004/0120737 | A1 | 6/2004 | Kataoka et al. | 399/328 |
| 2004/0120740 | A1 | 6/2004 | Uekawa et al. | 399/329 |

FOREIGN PATENT DOCUMENTS

| | | |
|---|---|---|
| JP | 1-150185 | 6/1989 |
| JP | 2-157878 | 6/1990 |
| JP | 4-44075 | 2/1992 |
| JP | 4-204980 | 7/1992 |
| JP | 6-308854 | 11/1994 |
| JP | 7-230231 | 8/1995 |
| JP | 7230231 A1 * | 8/1995 |
| JP | 2002-214961 | 7/2002 |

* cited by examiner

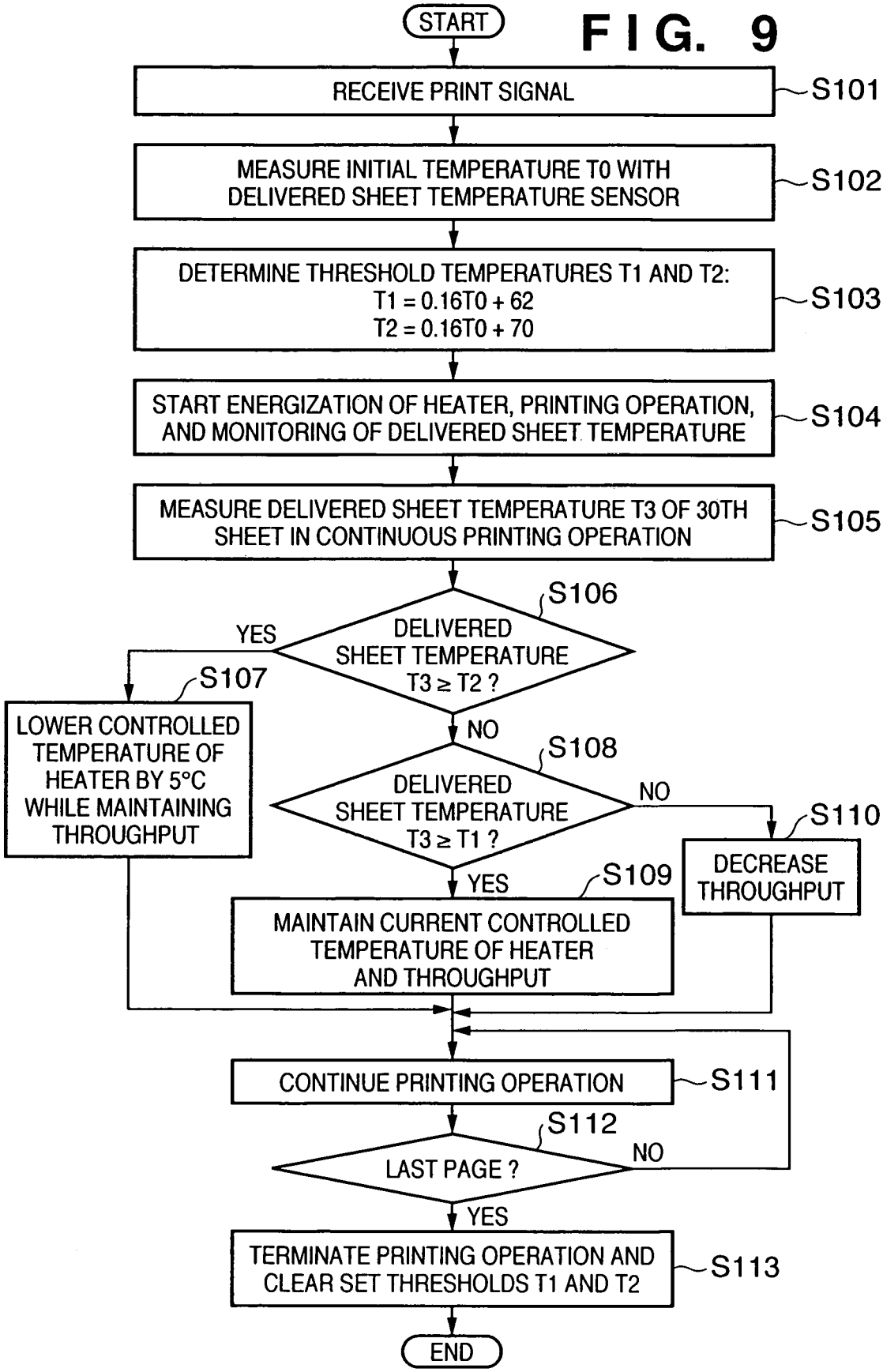
FIG. 9
START
RECEIVE PRINT SIGNAL
S101
MEASURE INITIAL TEMPERATURE T0 WITH DELIVERED SHEET TEMPERATURE SENSOR
S102
DETERMINE THRESHOLD TEMPERATURES T1 AND T2:
T1 = 0.16T0 + 62
T2 = 0.16T0 + 70
S103
START ENERGIZATION OF HEATER, PRINTING OPERATION, AND MONITORING OF DELIVERED SHEET TEMPERATURE
S104
MEASURE DELIVERED SHEET TEMPERATURE T3 OF 30TH SHEET IN CONTINUOUS PRINTING OPERATION
S105
S106
DELIVERED SHEET TEMPERATURE T3 ≥ T2 ?
YES
NO
S107
LOWER CONTROLLED TEMPERATURE OF HEATER BY 5°C WHILE MAINTAINING THROUGHPUT
S108
DELIVERED SHEET TEMPERATURE T3 ≥ T1 ?
NO
YES
S110
DECREASE THROUGHPUT
S109
MAINTAIN CURRENT CONTROLLED TEMPERATURE OF HEATER AND THROUGHPUT
CONTINUE PRINTING OPERATION
S111
S112
LAST PAGE ?
NO
YES
TERMINATE PRINTING OPERATION AND CLEAR SET THRESHOLDS T1 AND T2
S113
END

FIG. 13

| NUMBER OF SHEETS PRINTED | 1 TO 40 SHEETS | 41 TO 80 SHEETS | 81 TO 120 SHEETS | FROM 121ST SHEET |
|---|---|---|---|---|
| THROUGHPUT | 55ppm | 52ppm | 49ppm | 45ppm |

THIN SHEET B

FIG. 14A

| INITIAL TEMPERATURE | 23°C | | 50°C | | 70°C | |
|---|---|---|---|---|---|---|
| EVALUATION ITEM | STACKING CAPACITY | FUSING PROPERTIES | STACKING CAPACITY | FUSING PROPERTIES | STACKING CAPACITY | FUSING PROPERTIES |
| EMBODIMENT | 320 SHEETS | ○ | 328 SHEETS | ○ | 326 SHEETS | ○ |
| COMPARATIVE EXAMPLE 1 | 234 SHEETS | ○ | 242 SHEETS | ○ | 241 SHEETS | ○ |
| COMPARATIVE EXAMPLE 2 | 252 SHEETS | ○ | 327 SHEETS | ○ | 328 SHEETS | ○ |

ROUGH SHEET C

FIG. 14B

| INITIAL TEMPERATURE | 23°C | | 50°C | | 70°C | |
|---|---|---|---|---|---|---|
| EVALUATION ITEM | STACKING CAPACITY | FUSING PROPERTIES | STACKING CAPACITY | FUSING PROPERTIES | STACKING CAPACITY | FUSING PROPERTIES |
| EMBODIMENT | 262 SHEETS | ○ | 270 SHEETS | ○ | 264 SHEETS | ○ |
| COMPARATIVE EXAMPLE 1 | 264 SHEETS | × | 268 SHEETS | × | 267 SHEETS | × |
| COMPARATIVE EXAMPLE 2 | 262 SHEETS | ○ | 268 SHEETS | ○ | 265 SHEETS | △ |

THICK SHEET E

FIG. 14C

| INITIAL TEMPERATURE | 23°C | | 50°C | | 70°C | |
|---|---|---|---|---|---|---|
| EVALUATION ITEM | STACKING CAPACITY | FUSING PROPERTIES | STACKING CAPACITY | FUSING PROPERTIES | STACKING CAPACITY | FUSING PROPERTIES |
| EMBODIMENT | 285 SHEETS | ○ | 286 SHEETS | ○ | 289 SHEETS | ○ |
| COMPARATIVE EXAMPLE 1 | 283 SHEETS | ○ | 287 SHEETS | ○ | 286 SHEETS | ○ |
| COMPARATIVE EXAMPLE 2 | 253 SHEETS | ○ | 287 SHEETS | ○ | 288 SHEETS | △ |

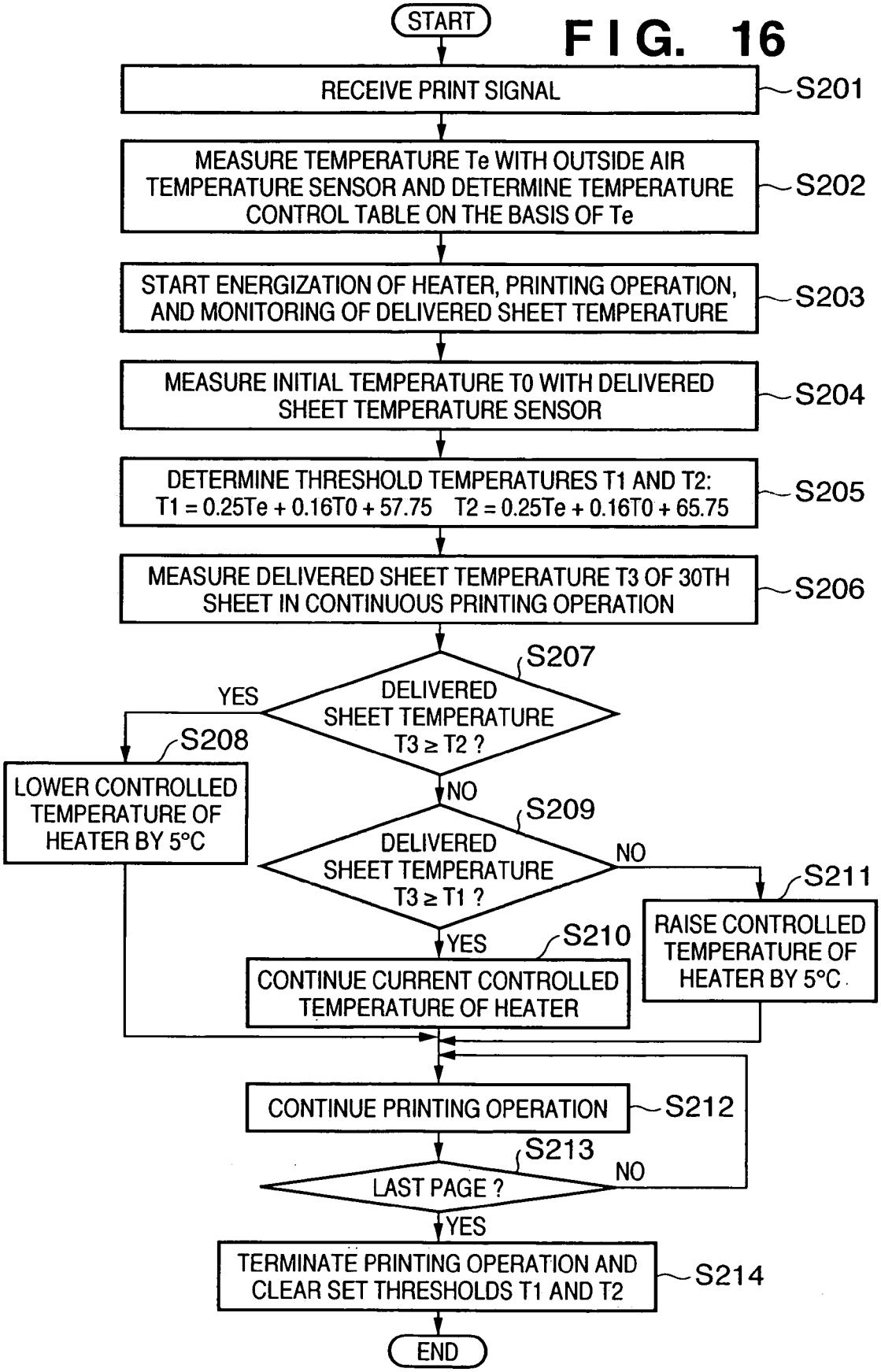
FIG. 16
START
RECEIVE PRINT SIGNAL
S201
MEASURE TEMPERATURE Te WITH OUTSIDE AIR TEMPERATURE SENSOR AND DETERMINE TEMPERATURE CONTROL TABLE ON THE BASIS OF Te
S202
START ENERGIZATION OF HEATER, PRINTING OPERATION, AND MONITORING OF DELIVERED SHEET TEMPERATURE
S203
MEASURE INITIAL TEMPERATURE T0 WITH DELIVERED SHEET TEMPERATURE SENSOR
S204
DETERMINE THRESHOLD TEMPERATURES T1 AND T2:
T1 = 0.25Te + 0.16T0 + 57.75 T2 = 0.25Te + 0.16T0 + 65.75
S205
MEASURE DELIVERED SHEET TEMPERATURE T3 OF 30TH SHEET IN CONTINUOUS PRINTING OPERATION
S206
S207
DELIVERED SHEET TEMPERATURE T3 ≥ T2 ?
YES
NO
S208
LOWER CONTROLLED TEMPERATURE OF HEATER BY 5°C
S209
DELIVERED SHEET TEMPERATURE T3 ≥ T1 ?
NO
YES
S210
CONTINUE CURRENT CONTROLLED TEMPERATURE OF HEATER
S211
RAISE CONTROLLED TEMPERATURE OF HEATER BY 5°C
CONTINUE PRINTING OPERATION
S212
S213
LAST PAGE ?
NO
YES
TERMINATE PRINTING OPERATION AND CLEAR SET THRESHOLDS T1 AND T2
S214
END

IMAGE FORMING APPARATUS AND ITS CONTROL METHOD

FIELD OF THE INVENTION

The present invention relates to an image forming apparatus and its control method and, more particularly, an image forming apparatus having a thermal fixing unit that fixes a toner image formed on a printing material by heating it and a control method for the apparatus.

BACKGROUND OF THE INVENTION

Many copying machines, printers, and the like based on an electrophotographic method use, as thermal fixing methods, a heating roller fusing method of a contact heating type which exhibits high thermal efficiency and safety and a film heating method of an energy saving type.

As shown in FIG. 19, a thermal fixing device based on the heating roller fusing method is basically comprised of a heating roller (fixing roller) 40 serving as a heating rotating member containing a heater 41 such as a halogen heater and an elastic pressurizing roller 50 serving as a pressurizing rotating member which comes into contact with the heating roller 40 to pressurize it. This pair of rollers are rotated, and a printing material P (a transfer sheet, print sheet, electrostatic printing sheet, electrofax sheet, or the like) serving as a material to be heated on which an unfused toner image is formed/borne is guided to the nip area (fusing nip area) between the roller pair. The printing material is then passed through the nip area to thermal-fuse the unfused toner image as a permanent fixed image on the printing material surface by using heat from the heating roller 40 and pressurizing force at the nip area. The heating roller 40 is configured such that a separating layer 43 made of fluororesin or the like is formed on the outer surface of a hollow cored bar 42 made of iron or the like. The pressurizing roller 50 is configured such that an elastic layer 52 made of silicone rubber or the like is formed on the surface of a cored bar 51 made of iron or the like, and a separating layer 53 such as a fluororesin tube is formed on the outer surface of the elastic layer. The heating roller 40 is heated by energizing the heater 41. The surface temperature of the heating roller 40 is detected by a temperature detection element such as a thermistor to be maintained at a predetermined temperature, thereby heating the nip area.

Thermal fixing devices based on the film heating method (on-demand fusing devices) are disclosed in, for example, Japanese Patent Laid-Open Nos. 63-313182, 2-157878, 4-44075, and 4-204980. FIG. 20 shows a typical example of these devices. Referring to FIG. 20, reference numeral 60 denotes a film assembly, which is configured such that a heater 61 having an electro heat-producing resistance layer formed on a ceramic substrate made of alumina, aluminum nitride, or the like is fixed to a stay holder 62 made of a heatproof resin, and a heatproof thin film 63 (to be referred to as a fusing film hereinafter) made of a resin such as polyimide or a metal such as SUS is loosely fitted on the stay holder 62. The heater 61 of the film assembly 60 and a pressurizing roller 50 clamp and pressurize the fusing film 63 to form a fusing nip area.

The fusing film 63 is conveyed/moved in the direction indicated by the arrow, while being in tight contact with and slid on the heater 61 at the fusing nip area, by the rotating/driving force of the elastic pressurizing roller 50 in the direction indicated by the arrow. The elastic pressurizing roller 50 is obtained by forming an elastic layer 52 made of silicone rubber or the like and a separating layer 53 made of fluororesin or the like on the surface of a cored bar 51. The temperature of the heater 61 is detected by a temperature detection means 64 such as a thermistor placed on the back of the heater and fed back to an energization control unit (not shown) to adjust the temperature of the heater 61 to a predetermined constant temperature (fusing temperature).

Various types of image forming apparatuses such as printers and copying machines which use such a thermal fixing device based on the film heating method have many advantages over image processing apparatuses using a thermal fixing device based on the conventional heating roller method. For example, they can eliminate the necessity of pre-heating and shorten the wait time because of high heating efficiency and quick startup.

Currently, a wide variety of printing materials used for image formation, which greatly change in thickness and surface properties, have been on the market. It is known that in the above conventional thermal fixing device, the fusing properties of toner images on such printing materials are influenced by the thicknesses and surface properties of the printing materials. The fusing properties are considerably degraded on a type of paper with rough surface properties, in particular. This is because the contact area between the heating member and the printing material decreases in the fusing nip area, and a sufficient amount of heat is not supplied to the toner on the printing material. As a consequence, in order to obtain good fusing properties even on a type of paper with poor surface properties, it is necessary to increase the fusing pressurizing force or fusing temperature.

The method of increasing the fusing pressurizing force, however, leads to an increase in the driving torque of the fusing device and hence tends to increase the device cost. In the above thermal fixing device based on the film system, in particular, since a fusing film that is a heating rotating member is slid on the heater serving as a heating member at the fusing nip area, the rotational torque tends to be high. This makes it difficult to increase the pressurizing force; the total pressure is limited to about 196 N (20 kgf) at most, and the linear pressure in the fusing nip area is set to be relatively low. It is therefore inevitable to raise the fusing temperature in order to improve the fusing properties of a type of paper with poor surface properties.

If, however, the fusing temperature is simply raised, an excessive amount of heat is supplied to a thin sheet or a sheet with good surface properties. This may lead to adverse effects, e.g., the occurrence of hot offset and an increase in the amount of curl of a sheet.

In addition, not only a fusing temperature but also a fusing nip width is important parameters for contradictory phenomena such as the fusing properties of toner images on printing materials, the curls of printing materials, and the hot offset of toner. That is, as the fusing nip width is increased, the time during which heat is transferred to a printing material is prolonged even at a low fusing temperature, and hence good fusing properties may be realized. In contrast, this suppresses the occurrence of phenomena such as the curls of printing sheets and the hot offset of toner.

Although the fusing nip width mainly depends on the hardness of a pressurizing roller and the pressurizing force of a pressurized spring, they change to some extent. Different fusing devices therefore have different fusing nip widths. For this reason, if fusing temperature setting is made in consideration of variations in fusing nip width, it is very difficult to satisfy requirements for all the phenomena such as fusing properties, curl, and hot offset with respect to various types of printing materials described above by setting only one temperature.

As described above, it is difficult to set fusing conditions optimal for both a printing material with rough surface properties and a printing material with good smoothness. Conventionally, in order to cope with this problem, a user selects a fusing temperature in accordance with the printing material to be used. It is, however, difficult for the user to set a fusing mode in accordance with a parameter like surface roughness that is incomprehensible to the user. For this reason, it has been required to automatically set an optimal fusing temperature in accordance with the printing material to be used (surface roughness in particular).

From this viewpoint, a method of feeding back information for fusing control by detecting the temperature of a printing material delivered from a fusing nip is disclosed in, for example, Japanese Patent Laid-Open Nos. 1-150185, 6-308854, 7-230231, and 2002-214961.

FIG. 21 shows an example of a conventional thermal fixing device designed to perform temperature detection by using a contact type sensor. In this thermal fixing device, a temperature sensor 18 such as a temperature detection thermistor is placed downstream of the fusing nip, and a facing member such as a rubber roller is placed at a position to face the temperature sensor 18 to clamp a printing material between them and measure its temperature.

FIG. 22 shows an example of a conventional thermal fixing device designed to perform temperature detection by using a non-contact type sensor. In this thermal fixing device, a non-contact type sensor 20 such as an infrared sensor is placed downstream of the fusing nip to measure the temperature of a printing material in a non-contact manner.

There has been proposed a method of preventing curl and hot offset by lowering the fusing temperature for a thin sheet or smooth sheet, which is easily heated, by feeding back information for energization control on the heater of a heating member on the basis of the measurement result on the delivery temperature of such a printing material, while satisfying requirements for fusing properties by raising the fusing temperature for a printing material with rough surface properties or a thick printing material.

The following problems, however, have arisen in the conventional thermal fixing device described above.

A method of detecting the temperature of a printing material while clamping it between a temperature sensor and a facing member such as a roller as shown in FIG. 21 will be described first. In this method, since the facing member of the temperature sensor is always in contact with a printing material, heat in the printing material is taken away by the facing member. This makes it impossible to accurately detect the temperature of the printing material. In order to stably clamp and convey a printing material, a rubber roller serving as a facing member needs to be formed to have a certain size. The heat capacity of the roller as the facing member cannot be neglected, and hence it is difficult to make a noticeable difference in the temperature detection thermistor in accordance with the surface roughness or thickness of a printing material. In addition, if a rubber roller is used as a facing member, the amount of heat taken away from a recoding material by the rubber roller changes depending on the surface properties of the rubber roller. If the surface condition of the rubber roller has changed after the passage of sheets, this causes a variation in detected temperature.

In addition, when the temperature of a printing material delivered from the fusing nip, consideration must be given to the influence of the dissipation of heat from the printing material delivered from the fusing nip. This is because the state of dissipation of heat from the printing material changes due to the influences of convection in the device and the temperature outside of the device in the area where the printing material delivered from the fusing nip is conveyed. For this reason, temperature detection is influenced more easily with the lapse of time after a printing material is delivered from the fusing nip, and hence different detection results are obtained by the temperature detection element even if identical printing materials are conveyed. For this reason, if the temperature detection element is placed next to the fusing nip, the influences of convection in the device and the like can be reduced, and the accuracy of the discrimination of a printing material can be improved.

On the other hand, if a temperature detection element such as a thermistor is placed next to the fusing nip, since the temperature of an atmosphere in which the temperature detection element changes depending on the heated state of the fusing roller and the fusing member for a fusing film or a past thermal fixing history, the type of printing material must be properly discriminated in each case.

From the above viewpoint as well, when a member such as a rubber roller having a large heat capacity is placed next to the fusing nip to face and come into contact with the temperature detection element, the rubber roller having a large heat capacity is easily influenced by the ambient temperature next to the fusing nip, and the heated state of the rubber roller placed to face the temperature detection element greatly changes. As a consequence, the amount of heat taken away from a printing material delivered from the fusing nip by the rubber roller changes. This makes it difficult to accurately discriminate the type of printing material in every case.

According to the prior art, in particular, a printing material is discriminated with a predetermined value by the temperature detection element placed next to the fusing nip. If, however, the temperature detection element is actually placed next to the fusing nip, the influence of ambient temperature cannot be neglected. This makes it difficult to accurately discriminate the type of printing material and optimally control the thermal fixing device.

A problem in temperature detection using a non-contact type sensor like the one shown in FIG. 22 will be described next. When a printing material is heated/fused, since moisture contained in the printing material is also heated at the same time, steam is produced from the surface of the printing material. The surface of the non-contact sensor is then covered with the steam. As a consequence, the sensor cannot correctly detect the temperature of the printing material. As described above, the temperature of a printing material is preferably detected immediately after it is delivered from the fusing nip in terms of reducing the influence of dissipation of heat from the printing material immediately after it is delivered from the fusing nip. On the other hand, temperature detection is most susceptible to the influence of steam from the printing material immediately after it is delivered from the fusing nip.

In order to prevent this, it may be conceivable to prevent the surface of a non-contact type sensor from being covered with steam by forming an air path or the like using a fan. In this case, however, this air path influences the temperature of the surface of a printing material. In consideration of variations in wind velocity, it is difficult to discriminate the printing material.

As described above, in practice, no technique has been developed to discriminate the type of printing material by measuring the temperature of the printing material using a non-contact type sensor such as an infrared sensor.

SUMMARY OF THE INVENTION

It is an object of the present invention to provide an image forming apparatus and its control method which can prevent deformation of a printing material and obtain stable fusing performance by automatically switching optimal fusing conditions in accordance with the type of printing material and the state of a fusing device.

An image forming apparatus and its control method according to an aspect of the present invention perform continuous printing operation which repeatedly sets a state in which when a preceding printing material passes through the nip area of a thermal fixing unit, a succeeding printing material has been supplied to an image forming unit and image forming operation has been started. In this continuous printing operation, first of all, a first temperature indicating an ambient temperature near the thermal fixing unit is measured at an early time point in the continuous printing operation. A second temperature indicating the temperature of the printing material which has passed through the press contact nip area at a predetermined time point during the continuous printing operation is measured. The amount of heat to be supplied to the succeeding printing material is controlled on the basis of the measured first and second temperatures.

Other and further objects, features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the descriptions, serve to explain the principle of the invention.

FIG. 9 is a flowchart showing operation in continuous printing by the image forming apparatus according to the first embodiment of the present invention;

FIG. 13 is a view showing an example of a table describing the relationship between the number of sheets printed and the throughput in the first embodiment of the present invention;

FIGS. 14A to 14C are views showing experimental results for the confirmation of the effects of the first embodiment of the present invention;

FIG. 16 is a flowchart showing operation in continuous printing by the image forming apparatus according to the second embodiment of the present invention;

DETAILED DESCRIPTION OF THE PREFERRED EMBODIMENTS

Preferred embodiments of the present invention will now be described in detail in accordance with the accompanying drawings. Note that the present invention is not limited by the disclosure of the embodiments and all combinations of the features described in the embodiments are not always indispensable to solving means of the present invention.

<First Embodiment>

(Schematic Arrangement of Image Forming Apparatus)

Figure 1:
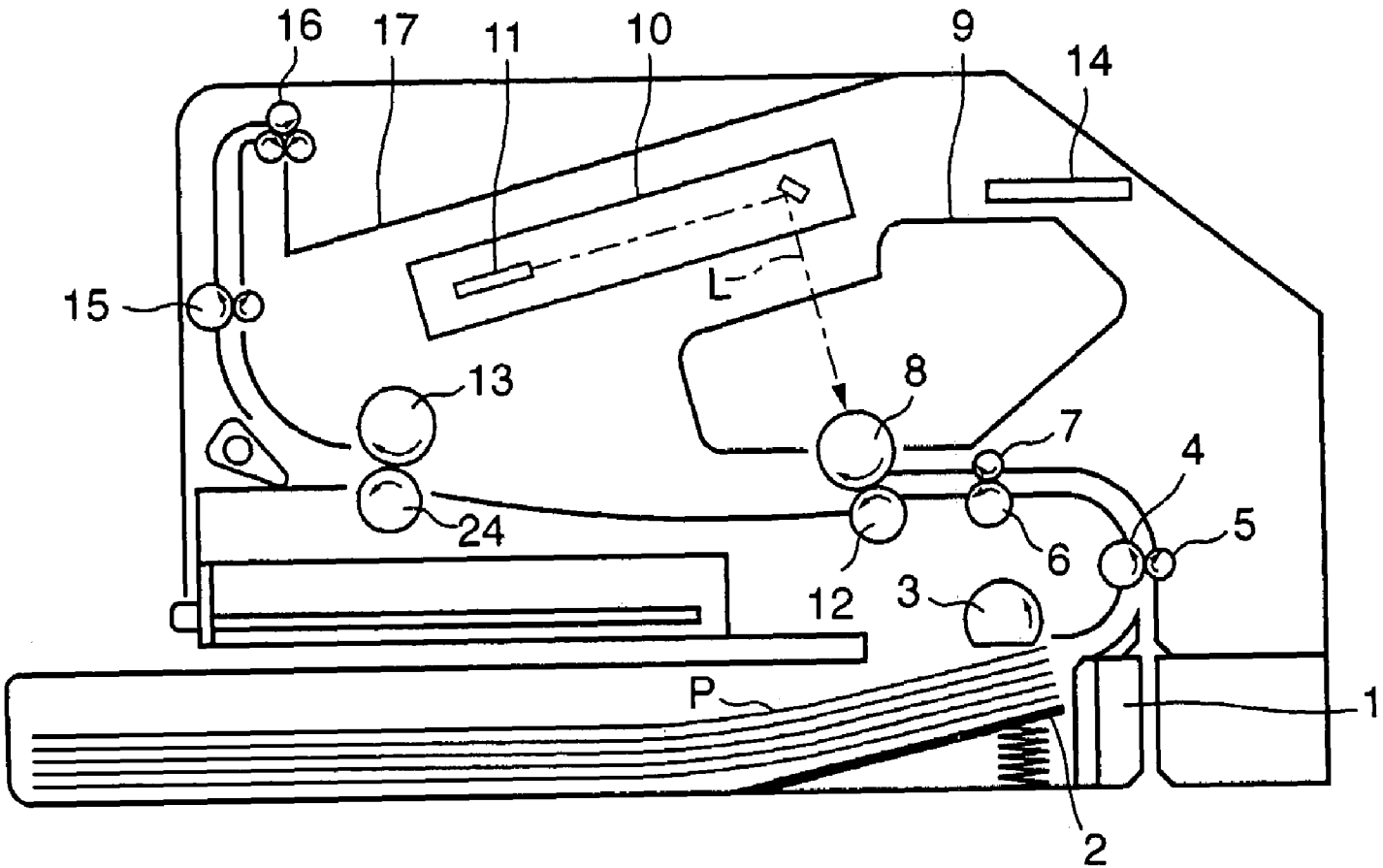
FIG. 1 is a schematic sectional view of an image forming apparatus according to the first embodiment of the present invention.

FIG. 1 is a schematic sectional view of an image forming apparatus according to this embodiment. This image forming apparatus includes a paper feed device comprising a paper feed tray 1, sheet stacking plate 2, and feed roller 3. Printing materials P stacked on the sheet stacking plate 2 in the paper feed tray 1 are picked up one by one by the feed roller 3, starting from the uppermost printing material, and conveyed to a registration unit by convey rollers 4 and 5. After the conveying direction of the printing material P is adjusted by the registration unit comprised of registration rollers 6 and 7, the printing material P is fed to an image forming unit.

The image forming unit is comprised of a photoconductive drum 8, toner cartridge 9, laser scanner unit 10, transfer drum 12, and the like. Although the illustration of the arrangement of the toner cartridge 9 will be omitted, the toner cartridge 9 has an arrangement in which a charger which charges the photoconductive drum 8, a developing device which develops a latent image on the photoconductive drum 8 with toner as a developing agent, a cleaner which removes and holds residual toner on the photoconductive drum 8, and the like are integrated into a unit. The laser scanner unit 10 is formed by integrating a polyhedral mirror 11, a motor (not shown) for rotating the polyhedral mirror, a laser unit, and the like into a unit.

A laser beam L based on image information is emitted from the laser scanner unit 10, and the photoconductive drum 8 is exposed to the laser beam, thereby forming a latent image based on the image information on the photoconductive drum 8 by the electrophotographic method. This latent image is developed by the developing device with toner. The developed toner image is transferred onto the printing material P by the transfer roller 12.

The printing material P on which the transfer of the toner image has been complete is conveyed to a thermal fixing device including a heating unit 13 and pressurizing roller 24. The transferred toner image is heated/fused by this device. Thereafter, the printing material P is delivered onto a delivered paper tray 17 by a paper delivery unit comprised of intermediate paper delivery rollers 15, paper delivery rollers 16, and the like.

Reference numeral 14 denotes a control circuit, which controls the image forming operation of the image forming unit and performs fusing control in the thermal fixing device.

(Arrangement of Thermal Fixing Device)

The arrangement of the image forming apparatus according to this embodiment has been described in brief. The arrangement of the thermal fixing device which heats/fuses an unfused toner image as a permanent image on the printing material P will be described in detail next.

Figure 2:
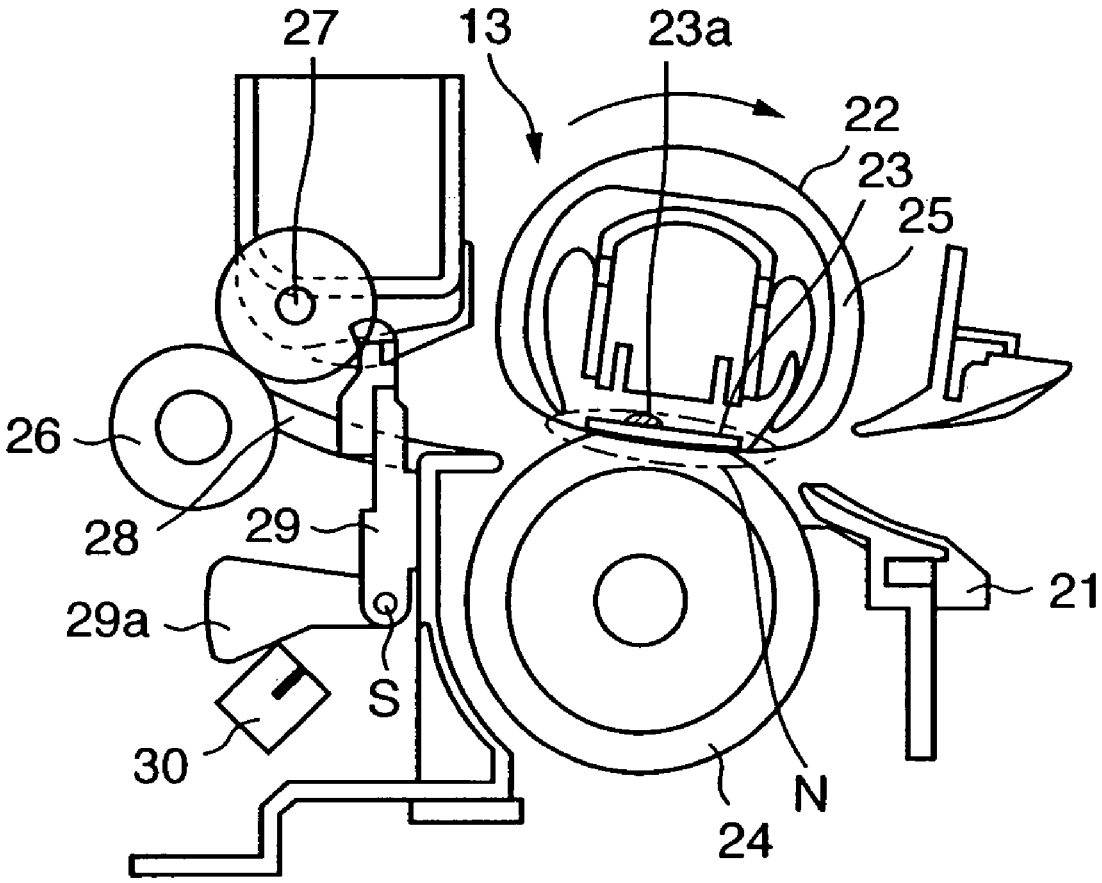
FIGS. 2 and 3 are schematic sectional views of a thermal fixing device according to the first embodiment of the present invention.
Figure 3:
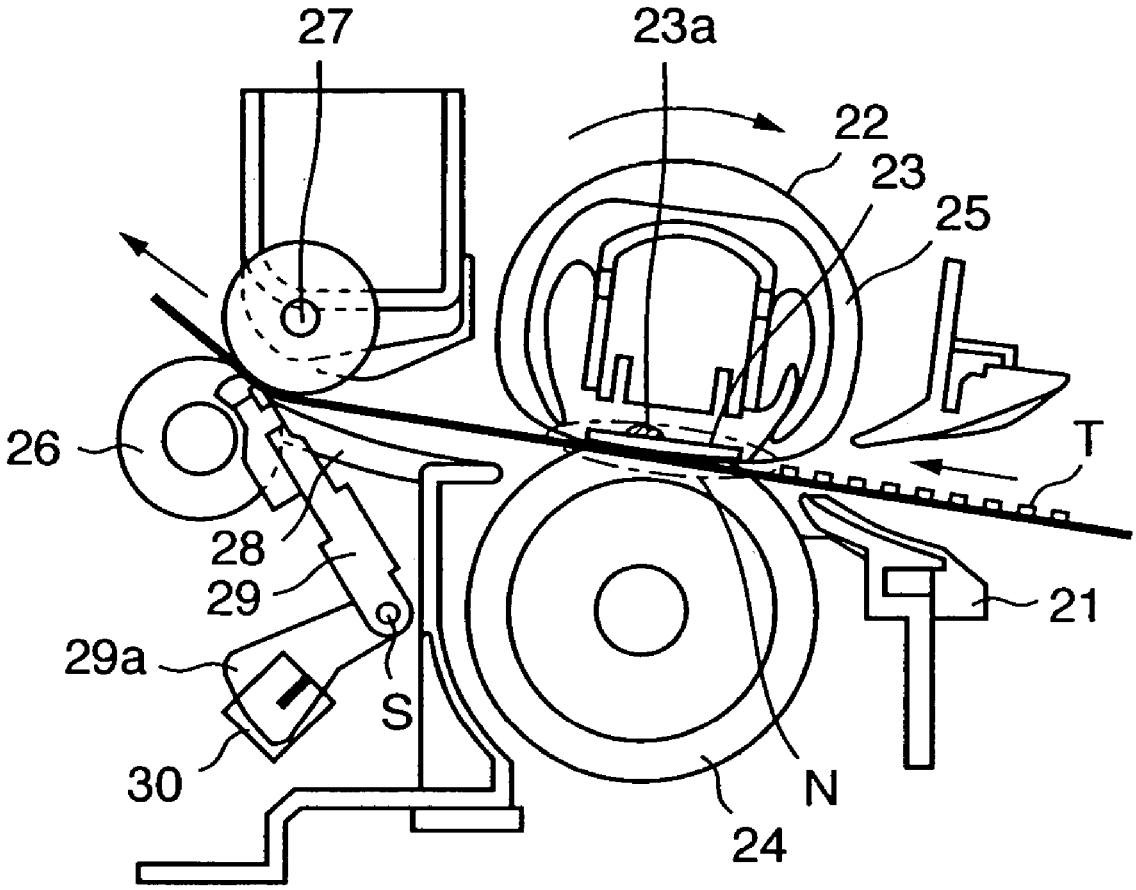

FIGS. 2 and 3 are schematic sectional views showing the arrangement of the thermal fixing device according to this embodiment. FIG. 2 shows a state wherein no printing material P is supplied to the thermal fixing device. FIG. 3 shows a state wherein the printing material P bearing an unfused toner image T is passing through the thermal fixing device. Note that this embodiment uses the thermal fixing device (on-demand fusing device) based on the film heating method, which heats/fuses a toner image on a printing material through a thin film. However, the present invention is not limited to this on-demand fusing device, but can be applied to a thermal fixing system such as a heating roller system which heats a printing material while clamping/conveying it by using a heating roller maintained at a predetermined temperature and a pressurizing roller which pressurizes the heating roller by coming into contact with the heating roller through an elastic layer.

As described above, the printing material is conveyed to the thermal fixing device after the toner image is developed and transferred by the image forming unit comprised of the photoconductive drum 8, transfer roller 12, and the like. The leading end of the printing material is guided through a fusing inlet guide 21 to a nip area N formed by a heater 23 and the pressurizing roller 24 with a thin fusing film 22 being clamped between them.

The thin film 22 is a thin, flexible fusing film in the form of an endless belt, which serves as a heating rotating member and is made of a heat-resistant resin such as polyimide, polyamide, or PEEK, or a metal such as SUS or Ni. As the surface layer of this fusing film, a fluororesin layer made of PFA, PTFE, or the like is formed as a separating layer. The heat capacity of the thin film 22 is reduced to improve its quick start property. To satisfy a requirement for mechanical strength, the thickness of the base material made of polyimide, SUS, or the like is set to 100 μm or less, preferably 60 μm or less and 20 μm or more, and the fluororesin layer serving as a separating layer is formed on the outer surface of the film to a thickness of about 8 μm to 16 μm. The thin film 22 in the form of an endless belt is fitted on an arcuated film guide member 25 formed from a liquid crystal polymer, ferrite, or a heat-resistance resin such as PPS, with some perimeter margin being ensured.

The pressurizing roller 24 serves as a rotating member for pressurization and has an elastic layer made of silicone rubber, silicone sponge rubber formed by foaming silicone rubber, or the like, which is formed on a cored bar made of iron, aluminum, or the like. In addition, the elastic layer is coated with a fluororesin layer made of PFA, PTFE, or the like as a separating layer or covered with it in the form of a tube.

The thin film 22 is rotated/driven upon rotating/driving of the pressurizing roller 24 in the clockwise direction indicated by the arrow at least at the time of the execution of image fusing operation in tight contact with the surface of the heating element (heater 23), while being slid on the surface of the heating element, at a predetermined peripheral velocity, i.e., a peripheral velocity almost equal to the convey speed of the printing material P bearing the unfused toner image T, which is conveyed from the image forming unit side (not shown), without any creases.

The heater 23 is, for example, a ceramic heater, which includes an electro heat-producing element (resistive heat-producing element) and raises the temperature by making the electro heat-producing element generate heat. This heating element uses alumina ($Al_2O_3$) or aluminum nitride (AlN) for its substrate. A heating element pattern having a desired resistive value is formed on the substrate by printing a thick resistive element made of silver or palladium on the substrate by a screen printing method or the like. In addition, a glass layer serving as a sliding layer for the protective layer/fusing film is formed on the heating element. A thermistor 23*a* serving as a heat temperature detection element is bonded/fixed on the reverse side to the surface on which the heating element is formed, or is brought into contact with the surface with a predetermined pressure, thereby monitoring the temperature of the heater. The monitor temperature information is input to the control circuit 14. In order to maintain the heater temperature at a predetermined temperature, the control circuit 14 controls a driver to control the amount of electricity supplied from an AC power supply to the heating element of the heater by a phase control method, wave number control method, or the like.

Assume that the electro heat-producing element of the heater 23 is heated by supplying power to the heating element, and the fusing film 22 is rotated/driven. In this state, when the printing material P is guided to the nip area N (fusing nip area) formed between the pressurizing roller 24 and the heater 23 by elastic force generated by the deformation of the elastic layer of the pressurizing roller 24, the printing material P passes through the nip portion N while being in tight contact with the fusing film 22 and stacked thereon.

In the process of passing through the fusing nip portion, the printing material P receives heat energy and pressurizing force from the heater through the fusing film 22. As a consequence, the unfused toner image on the printing material P is heated and thermal-fused. Thereafter, the printing material P passes through the fusing nip portion N and separates from the fusing film 22. The printing material P is then delivered and conveyed to the paper delivery unit by the paper delivery rollers 26 and 27.

A fused paper delivery guide 28 which forms a printing material convey path is provided between the fusing nip portion N and the paper delivery roller nip portion (formed by the paper delivery rollers 26 and 27). The fused paper delivery guide 28 is made of a heatproof material such as PBT or PET. The convey surface of the fused paper delivery guide 28 is set below a line A connecting the fusing nip portion N and the paper delivery roller nip portion (see FIG. 4). In addition, the printing material convey speed at the paper delivery roller 26 is set to be higher than that at the fusing nip portion N. This prevents the printing material P from coming into direct contact with the convey surface of the fused paper delivery guide 28 when a printing material passes.

A paper delivery sensor unit which detects the presence/absence of a printing material passing through the thermal fixing device is placed on the printing material convey path extending from the thermal fixing device to the paper delivery unit. This paper delivery sensor unit is mainly comprised of a paper delivery sensor lever 29 and photointerrupter 30.

Figure 6:
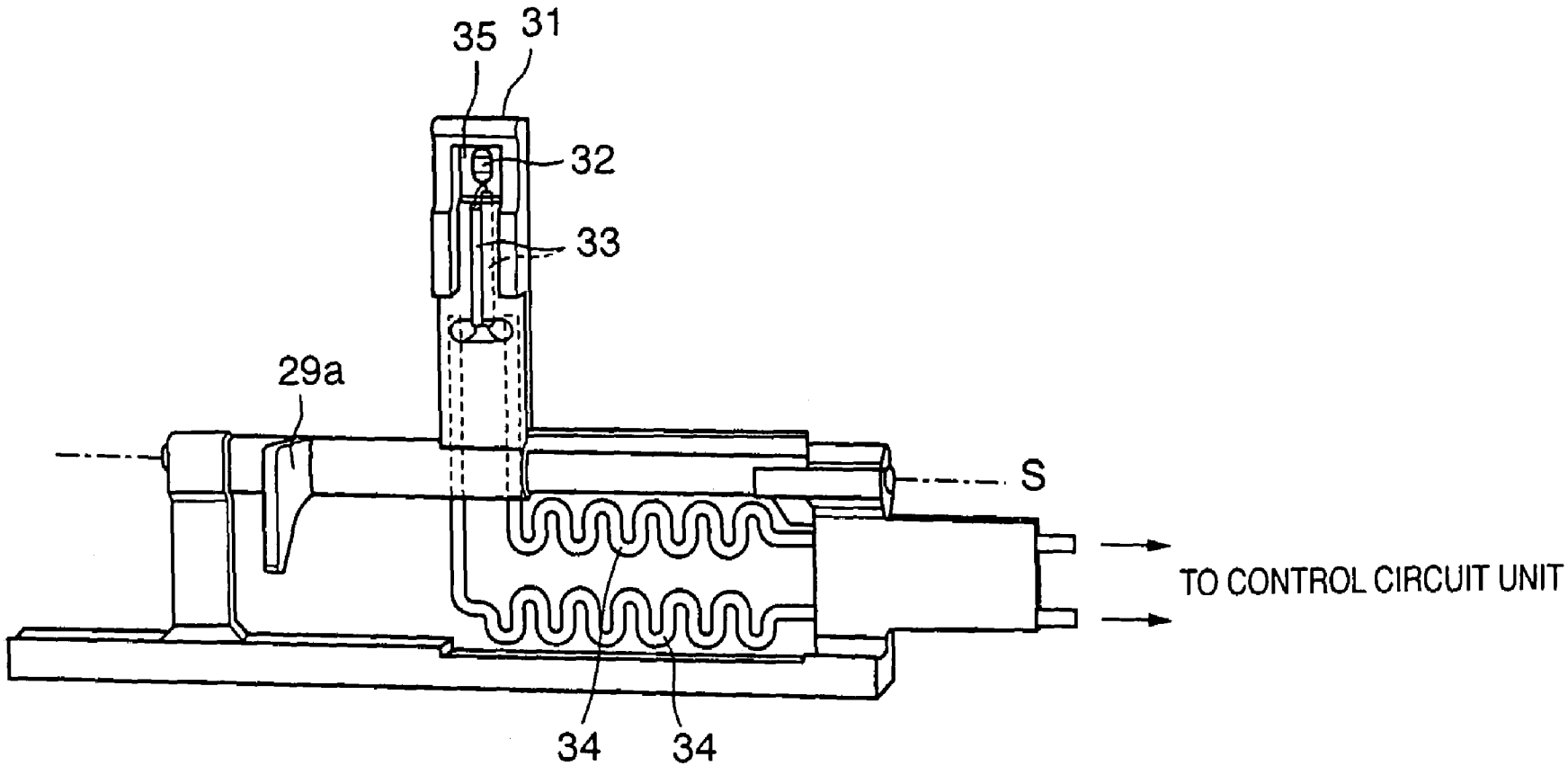
FIG. 6 is a perspective view showing the schematic arrangement of a portion near a delivery sensor lever according to the first embodiment of the present invention.
Figure 7:
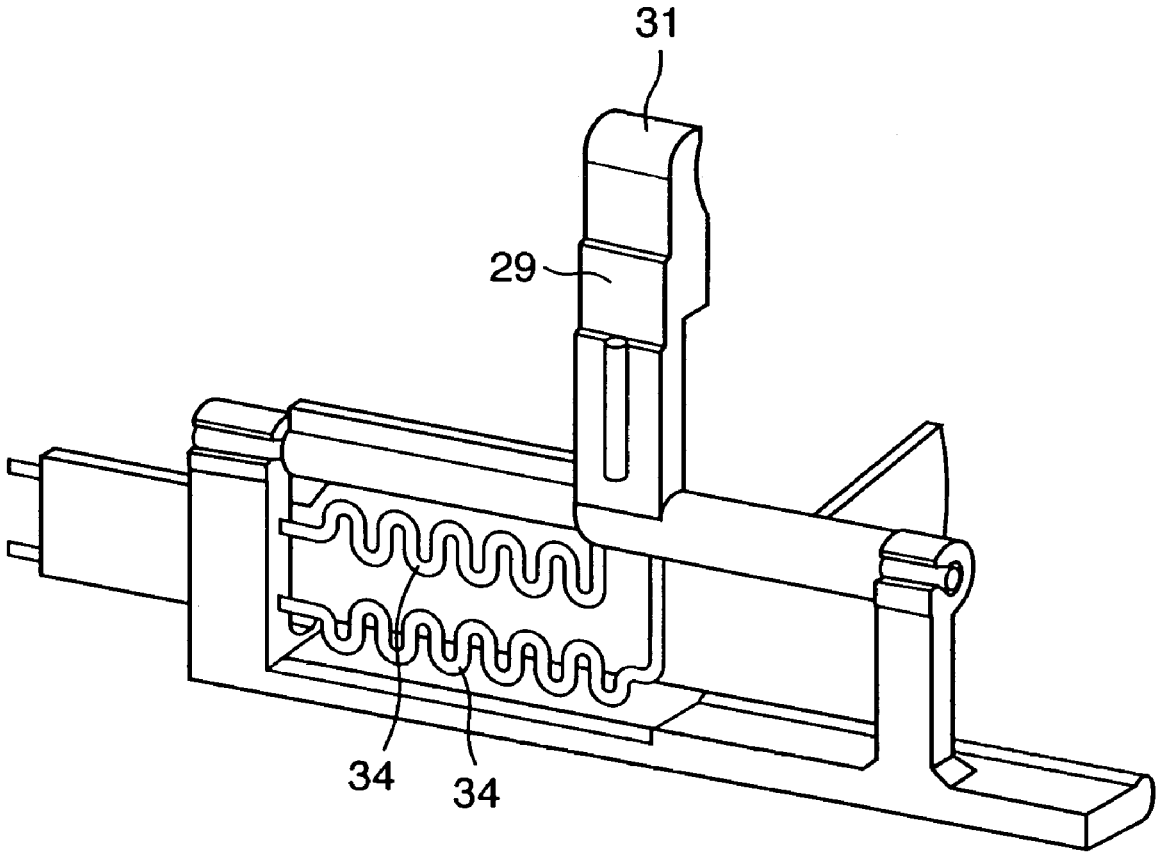
FIG. 7 is a perspective view showing the schematic arrangement of a portion near the delivery sensor lever according to the first embodiment of the present invention when viewed from the opposite direction to that of FIG. 6.

FIGS. 6 and 7 are perspective views showing the schematic arrangement of this paper delivery sensor unit. FIG. 7 is a view showing this unit when viewed from the opposite side to FIG. 6. The paper delivery sensor lever 29 is mainly formed from a plastic member with high slidability such as polyacetal, and a printing material passage portion at its distal end is placed as a home position at a position to shield the line A (FIG. 4) connecting the fusing nip portion N and the paper delivery roller nip portion. A shielding member 29*a* protrudes from the paper delivery sensor lever 29 in a direction perpendicular to the lever body. The paper delivery sensor lever 29 is configured to integrally pivot about a fulcrum S. When a printing material passes, the paper delivery sensor lever 29 falls in the printing material convey direction (see FIG. 3). Along with this movement, the shielding member 29*a* shields infrared light from the photointerrupter 30. When there is no printing material, the paper delivery sensor lever 29 returns to the home position, and the shielding member 29*a* comes to a position where it does not shield infrared light from the photointerrupter 30 (see FIG. 1). By moving the paper delivery sensor lever 29 in this manner, infrared light from the photointerrupter 30 is turned on/off to detect the presence/absence of a printing material.

As will be described below, in the image forming apparatus of this embodiment, the paper delivery sensor unit placed in the above manner is provided with a delivered sheet temperature detection unit comprised of a heat collecting plate and temperature detection sensor.

This delivery paper temperature detection unit is configured to detect the temperature of the unprinted surface of a printing material which has undergone image fusing and is delivered from the thermal fixing device. There are two merits in detecting the temperature of the unprinted surface of a printing material. First, in normal single-sided printing, a printing material comes into contact with the heat collecting plate at the surface opposite to the surface on which toner is fused, temperature detection is free from the influence of the adhesion of toner to the heat collecting plate. That is, there is no chance of degradation of temperature detection accuracy due to the adhesion of toner to the heat collecting plate. Second, since heat energy is mainly supplied from the heater 23 to the printed surface of a printing material through the fusing film 22, detecting the temperature of the unprinted surface makes it possible to predict the characteristics of each printing material from the detected temperature by using the differences in temperature gradient characteristics among printing materials which are based on heat conduction from the printing material printed surface side to the unprinted surface side. For example, the temperature on the unprinted surface side of a thin printing material is higher than that on the unprinted surface side of a thick printing material. A printing material with smooth surface properties can obtain higher adhesion properties with respect to the fusing film 22 at the fusing nip portion than a printing material with rough surface properties, and hence makes heat energy conduct more readily. As a consequence, the temperature on the unprinted surface side of the printing material with smooth surface properties becomes higher than that of the other.

Figure 5:
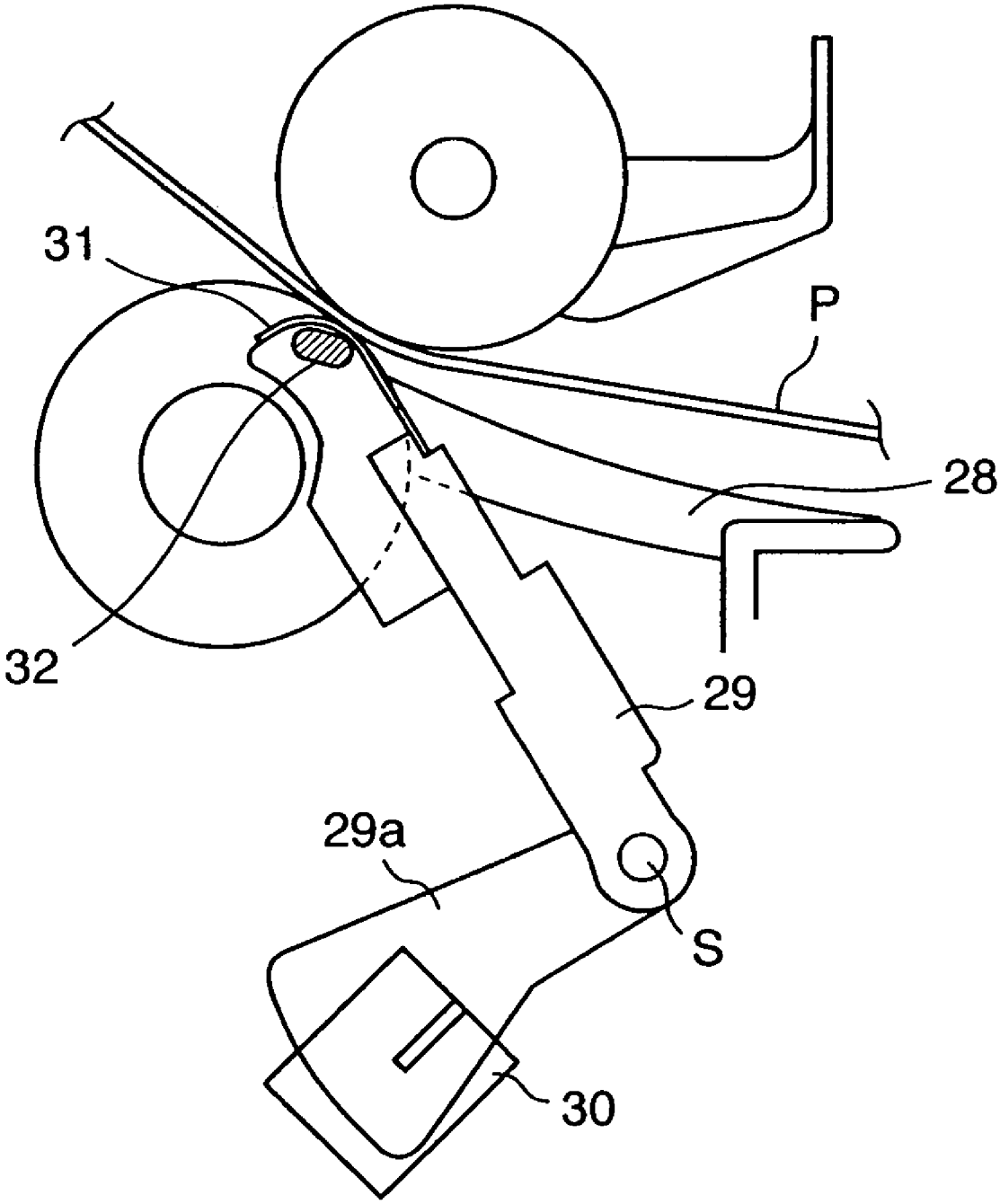
FIG. 5 is a schematic sectional view showing the thermal fixing device according to the first embodiment of the present invention and explaining the arrangement of a delivery sensor unit.

FIG. 5 is a detailed view of a portion near the paper delivery sensor lever 29. At the printing material passage portion on the distal end of the paper delivery sensor lever 29, the heat collecting plate 31 formed from a thin plate which has a thickness of about 0.1 mm and is made of aluminum, stainless steel, or the like which has a small heat capacity is integrally formed with the paper delivery sensor lever 29 by outsert molding or the like. The heat collecting plate 31 is brought into contact with the unprinted surface of a printing material delivered from the thermal fixing device by a biasing means such as a spring.

Figure 4:
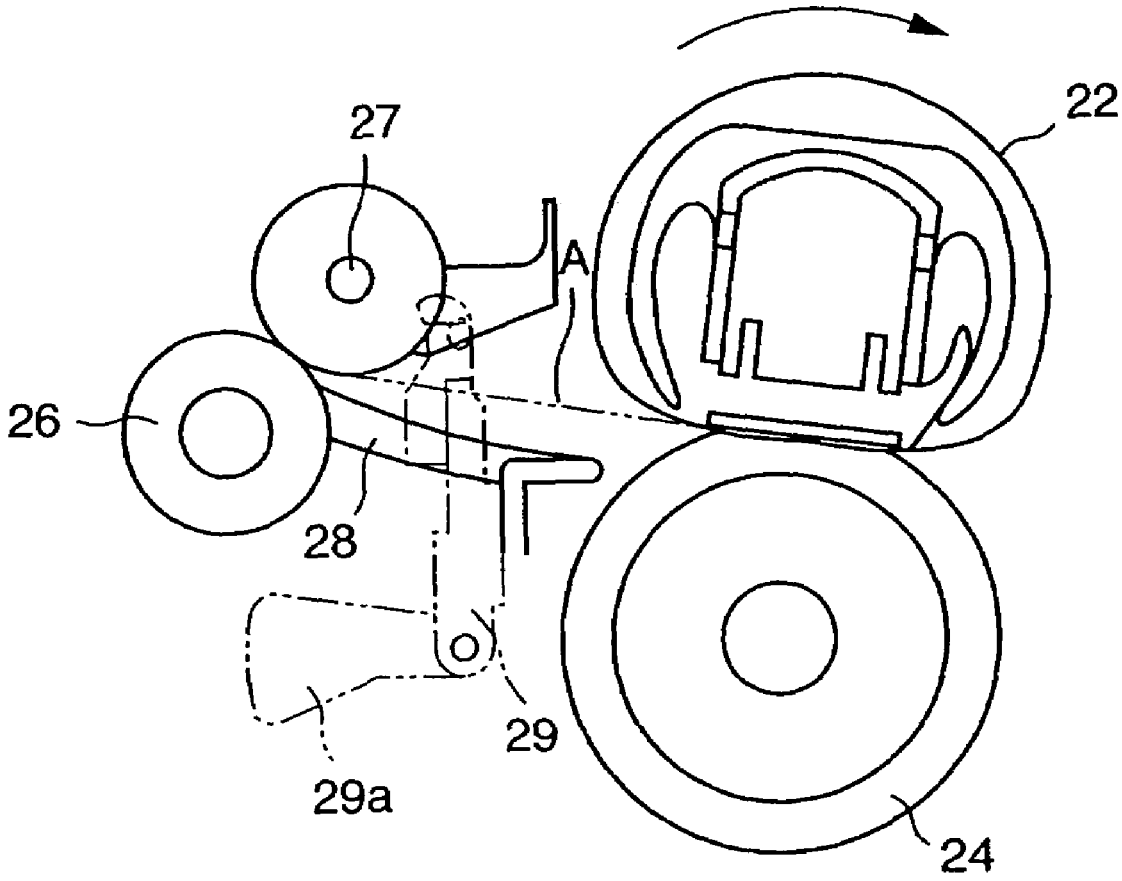
FIG. 4 is a schematic sectional view showing the thermal fixing device according to the first embodiment of the present invention and explaining the arrangement of a fused paper delivery guide.

The heat collecting plate 31 is placed above the line A connecting the fusing nip portion and the paper delivery roller nip portion (see FIG. 4). The leading end of a printing material which has passed through the fusing nip portion comes into contact with the plastic portion of the paper delivery sensor lever 29 first. When the printing material is further fed to the downstream side, the paper delivery sensor lever 29 pivots, and the heat collecting plate 31 comes into contact with the unprinted surface of the printing material. Reducing the heat capacity of the heat collecting plate 31 and actively bringing the heat collecting plate 31 into contact with a printing material in this manner can raise the temperature of the heat collecting plate 31 within a short period of time in accordance with the temperature of the printing material. In this case, in order to reduce the heat capacity of the heat collecting plate 31, it is preferable to minimize the size of the heat collecting plate 31 in the printing material convey direction and a direction which is perpendicular to the printing material convey direction and almost parallel to the width of a printing material.

In performing double-sided printing, when the second surface of a printing material passes through the fusing nip portion, the heat collecting plate 31 on the paper delivery sensor lever comes into contact with the first surface of the printing material, i.e., the printed surface. Therefore, toner may adhere to the surface of the heat collecting plate. In order to prevent this, the surface of the heat collecting plate 31 may be coated with fluororesin such as PFA or PTFE, or may be subjected to surface treatment such as UV coating within the range in which no influence is exerted on the heat conduction of the heat collecting plate 31. Alternatively, a PI (polyimide) coating or the like may be formed on the surface of the heat collecting plate 31.

A temperature sensor (delivered sheet temperature sensor) 32 with a fast response characteristic such as a thermistor is bonded to the rear surface of the heat collecting plate 31 at the distal end of the paper delivery sensor lever by adhesion or the like. When the printing material P on which an image is fused is conveyed from the thermal fixing device, the paper delivery sensor lever 29 pivots, and the heat collecting plate 31 comes into contact with the unprinted surface of the printing material P. As a consequence, the heat collecting plate 31 takes away heat from the printing material and conducts the heat to the delivered sheet temperature sensor 32 placed on the rear surface, thereby making the sensor detect a temperature dependent on the temperature of the printing material. When the paper delivery sensor lever 29 pivots, i.e., the paper delivery sensor lever 29 detects the presence of the printing material, since the delivered sheet temperature sensor 32 is placed immediately below the position where the printing material P and the heat collecting plate 31 come into contact with each other, the accuracy of the detected temperature dependent on the temperature of the printing material is improved by minimizing the influence of a temperature gradient in the heat collecting plate. In addition, using a metal member for a sliding portion which slides on a printing material makes it possible to prevent the wear of the sliding portion and improve the durability of the paper delivery sensor lever 29.

Providing the heat collecting plate 31 and the delivered sheet temperature sensor 32 such as a thermistor on the paper delivery sensor lever which detects the presence/absence of a printing material in this manner can accurately synchronize the position information and temperature information of the printing material and hence can accurately detect at which position on the printing material the temperature information output from the thermistor has been obtained. For example, temperature information from the thermistor indicates that the temperature of the trailing end portion of a printing material tends to be higher than that of the leading end portion. Therefore, by synchronizing the temperature information of the printing material with the position information, a temperature dependent on the temperature of the printing material can be detected more accurately.

A thermistor is an element which changes its resistance with a change in temperature and is sealed in glass while a Dumet wire 33 is fused to the electrode of a thermistor chip. The paper delivery sensor lever 29 is configured such that two electrodes 34 made of a metal such as stainless steel are integrally formed with a plastic portion by outsert molding or the like (see FIGS. 6 and 7). The Dumet wire 33 described above is welded to the two electrodes. These electrodes are further connected to the control circuit 14 to transfer the temperature information detected by the thermistor.

Each electrode 34 is formed from a thin sheet metal which is about 0.1 mm thick and made of stainless steel, and has both the function of transferring temperature information from the thermistor to the control circuit 14 and the function of biasing pivoting force to the paper delivery sensor lever 29. One end portion of each electrode 34 is integrally formed with the plastic portion of the paper delivery sensor lever 29 and welded to the Dumet wire 33 of the thermistor. The other end portion of each electrode 34 is connected to a terminal (not shown) fixed to the fused paper delivery guide 28. As the paper delivery sensor lever 29 pivots, the electrodes 34 move together with the paper delivery sensor lever 29 and are twisted from the fixed terminal connecting portions, thereby biasing pivoting force to the paper delivery sensor lever 29 in a direction to return it to the home position. Each electrode 34 is formed in the shape of a crank so as to bias proper pivoting force to the paper delivery sensor lever 29 and prevent itself from being permanently deformed or fractured upon receiving repetitive stress.

The distal end portion of the paper delivery sensor lever will be described in more detail. As described above, the heat collecting plate 31 made of a material with a small heat capacity is integrally formed with the paper delivery sensor lever 29 made of a plastic material with a low thermal conductivity at the distal end portion of the paper delivery sensor lever. In this case, the rear surface of the heat collecting plate 31 is a hollow portion 35 except for a joining portion with respect to the paper delivery sensor lever portion. This reduces the heat capacity of a portion near the heat collecting portion. In addition, thermally insulating the heat collecting plate 31 and paper delivery sensor lever 29 makes it possible to prevent heat collected at the delivered sheet temperature sensor 32 from escaping, thereby improving the response characteristic of the delivered sheet temperature sensor 32.

Figure 8:
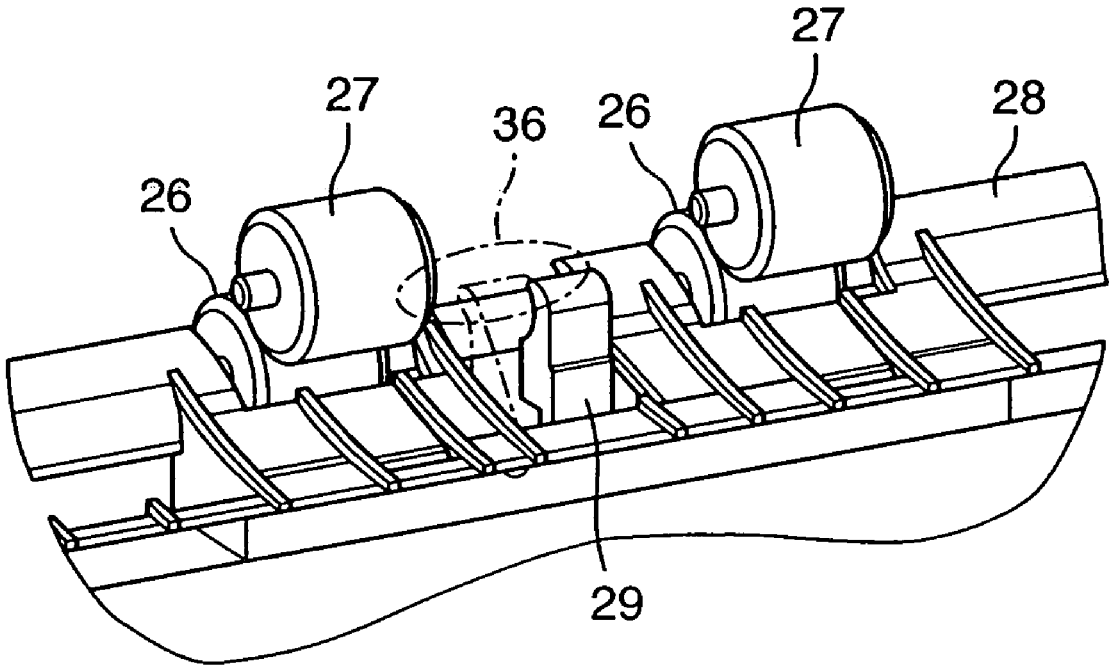
FIG. 8 is a perspective view of a portion near the delivery sensor lever of the fused paper delivery guide according to the first embodiment of the present invention.

A portion near the paper delivery sensor lever of the fused paper delivery guide 28 will be further described below with reference to FIG. 8. The fused paper delivery guide 28 has a large runout 36 with respect to a position where the paper delivery sensor lever 29 pivots so as to prevent a printing material from coming into contact with the sheet passage surface of the fused paper delivery guide 28 at a position near the portion where the printing material comes into contact with the paper delivery sensor lever 29. This prevents heat near the heat collecting plate from escaping to the fused paper delivery guide 28, thereby improving the accuracy of a detected temperature dependent on the temperature of the printing material. In addition, the paper delivery sensor lever 29 is placed at a position shifted from the nip between the paper delivery rollers 26 and 27 in the axial direction (the widthwise direction of a printing material) so that when the printing material passes through the nip, the paper delivery sensor lever 29 overlaps the paper delivery roller 26. Therefore, the biasing force of the paper delivery sensor lever 29 will not bend the printing material.

It is confirmed that the temperature detected by the delivered sheet temperature sensor 32 placed at the paper delivery sensor lever 29 is influenced by the type of printing material conveyed to the fusing nip portion, as described above. Automatically changing fusing conditions in accordance with this detected temperature can prevent the occurrence of an image failure such as hot offset and the deformation of a printing material such as the curl of the printing material regardless of the type of printing material, thereby obtaining stable fusing performance.

(Operation Sequence Based on Delivered Sheet Temperature Sensor)

An operation sequence based on the transition of temperatures detected by the delivered sheet temperature sensor and detected temperatures in this embodiment in a case wherein toner images on various types of printing materials are heated/fused will be described in detail below.

The image forming apparatus of this embodiment is, for example, a laser beam printer with a process speed of 320 mm/sec, which prints 55 LTR-size printing materials per min. As a thermal fixing device, a heating member was used. This heating member was configured such that a fusing film formed by sequentially coating the upper surface of a SUS 304 seamless metal film, as a base layer, having an outer diameter of 30 mm and a thickness of 40 μm with a 4 μm thick primer layer and a 10 μm thick, resistance-adjusted fluororesin layer was rotatably placed on the sliding surface of a heater formed by screen-printing an electro heat-producing member formed from an Ag/PD paste on an AlN substrate having a thickness of 0.6 mm and a width of 12 mm. As a pressurizing roller, a roller formed by covering the outer surface of an aluminum cored bar having a diameter of 22 mm with a 4-mm thick conductive silicone rubber as an elastic layer, and also covering the upper layer of the elastic layer with a PFA tube was used. The pressurizing force to be applied between the above fusing member and the pressurizing roller was set to 15 kgf. As described above, the paper delivery sensor lever 29 was placed downstream of the fusing nip portion, and a SUS plate having a thickness of 0.1 mm, a width of 6 mm, and a height of 8 mm was mounted on the distal end of the lever. The sensitive portion of a compact thermistor as the delivered sheet temperature sensor 32 was adhered and fixed to the rear surface of the SUS plate with an epoxy-based adhesive. The distance from the center of the fusing nip portion to the paper delivery sensor lever 29 at the home position was set to 25 mm in the printing material convey direction so as to accurately correlate the temperature of the unprinted surface of a printing material delivered from the fusing nip portion with the delivered sheet temperature sensor 32.

The transition of temperatures detected by the delivered sheet temperature sensor 32 was measured when various types of printing materials were subjected to continuous printing in the above arrangement.

In this specification, "continuous printing" indicates operation of repeatedly setting a state wherein when a preceding printing material passes through the fusing nip portion, a succeeding printing material has been supplied to the image forming unit and image forming operation has already been started, while the distance (sheet interval) between the trailing end of the preceding printing material and the leading end of the succeeding printing material is maintained almost constant. More specifically, in this embodiment, continuous printing is printing operation of repeatedly setting a state wherein when the trailing end of a heated/fused printing material passes through the paper delivery sensor lever 29, the succeeding printing material has already passed through the registration roller 6, and the transfer of a toner image onto the printing material has been started.

In an experiment, in order to set the same conditions, a standby state in which the heater was not energized was continued for a long period of time, and continuous printing operation for various types of printing materials was started from a state in which the temperature of the heater was nearest to room temperature (temperature outside the apparatus) at which the image forming apparatus was installed (to be referred to as an early-morning state hereinafter). In addition, the printing materials used in this experiment were cut sheets.

The printing materials used in the experiment were: a thin sheet A with a basis weight of 64 g/m$^2$ and smooth surface properties; a thin sheet B with a basis weight of 80 g/m$^2$ and a surface roughness slightly greater than that of the thin sheet A; a rough sheet C with a basis weight of 90 g/m$^2$ and very rough surface properties; and a thick sheet D with a basis weight of 135 g/m$^2$ and smooth surface properties. All the printing materials used in the experiment had the LTR size (width: 216 mm, length: 279 mm).

Figure 10:
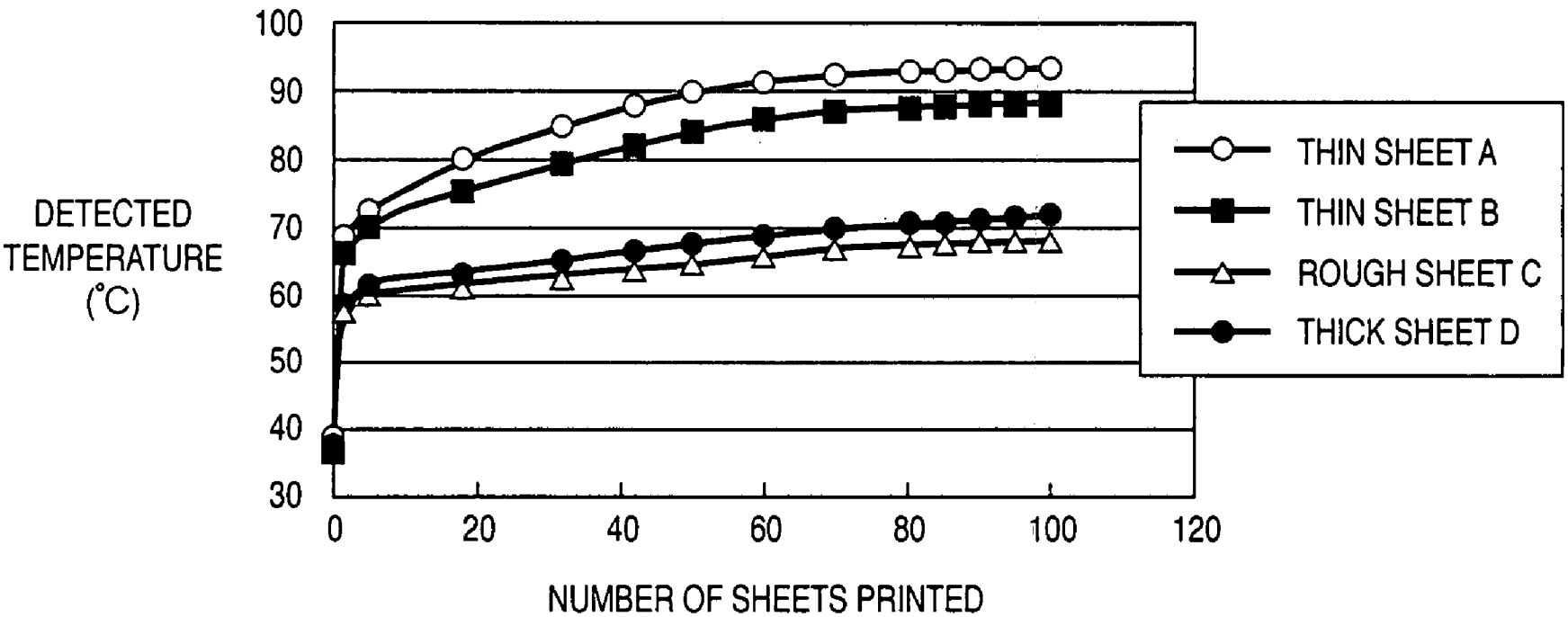
FIG. 10 is a graph showing the transition of delivered sheet temperatures of each printing material in continuous printing operation.

FIG. 10 shows the experimental results. Referring to FIG. 10, the abscissa represents the number of sheets subjected to continuous printing; and the ordinate, the temperature detected by the delivered sheet temperature sensor 32. As is obvious from FIG. 10, the thin sheet A having the smooth surface exhibits the transition of detected temperatures at the highest level. The thin film B having slightly rougher surface properties and a slightly larger basis weight than those of the thin sheet A exhibits the transition of detected temperatures at a level slightly lower than that of the thin sheet A. The rough sheet C and thick sheet D exhibit the transitions of detected temperatures at levels considerably lower than those of the thin sheets A and B. This indicates that as the surface properties become rougher, since the adhesion properties of printing materials with respect to a fusing film deteriorate, the conduction of heat from the fusing film surface to the printing materials deteriorates. In addition, this indicates that the temperature of the unprinted surface of a thick printing material does not easily rise because of a large heat capacity even if the sheet has smooth surface properties. That is, the above experimental results indicate that the type of printing material having undergone a thermal fixing process can be discriminated on the basis of the temperature detected by the delivered sheet temperature sensor 32.

An experiment was then conducted by performing similar continuous printing operation by using the thin sheet B and rough sheet C in a case wherein printing was started at different temperatures (initial temperatures) detected by the delivered sheet temperature sensor 32. More specifically, (1) after the transition of detected temperatures in continuous printing operation starting from an early-morning state was measured, the image forming apparatus was left in a standby state for about 2 min, and (2) the transition of detected temperatures in continuous printing operation starting from a state wherein the heating member and pressurizing roller were heated to some extent (this state will be referred to as a hot state hereinafter) was measured.

Figure 11:
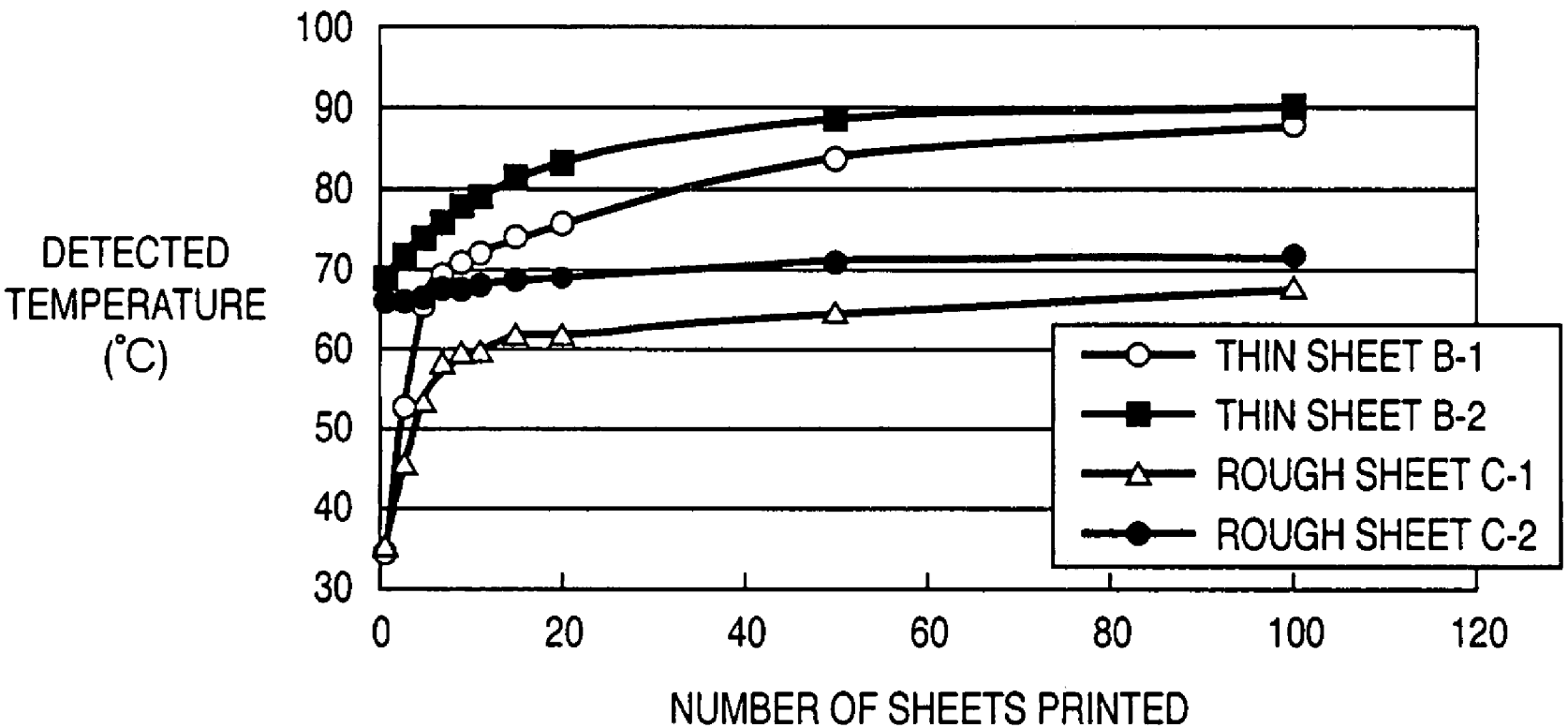
FIG. 11 is a graph showing the transition of delivered sheet temperatures for each initial temperature in continuous printing operation.

FIG. 11 shows the measurement results. A thin sheet B-1 and rough sheet C-1 show the transitions of detected temperatures in continuous printing operation starting from an early-morning state, whereas a thin sheet B-2 and rough sheet C-2 show those in continuous printing operation starting from a hot state. As is obvious from FIG. 11, with regard to the respective printing materials, the transitions of temperatures detected by the delivered sheet temperature sensor 32 in continuous printing operation starting from a hot state occur at levels higher than those in continuous printing operation starting from an early-morning state. It is also obvious that rises in temperature from the start of printing operation starting from the hot state are smaller than those from the start of printing operation starting from the early-morning state. This is because, since the paper delivery sensor lever 29 is placed near the fusing nip portion, the ambient temperature near the heating member and pressurizing roller is detected at the start of printing operation.

Figure 12:
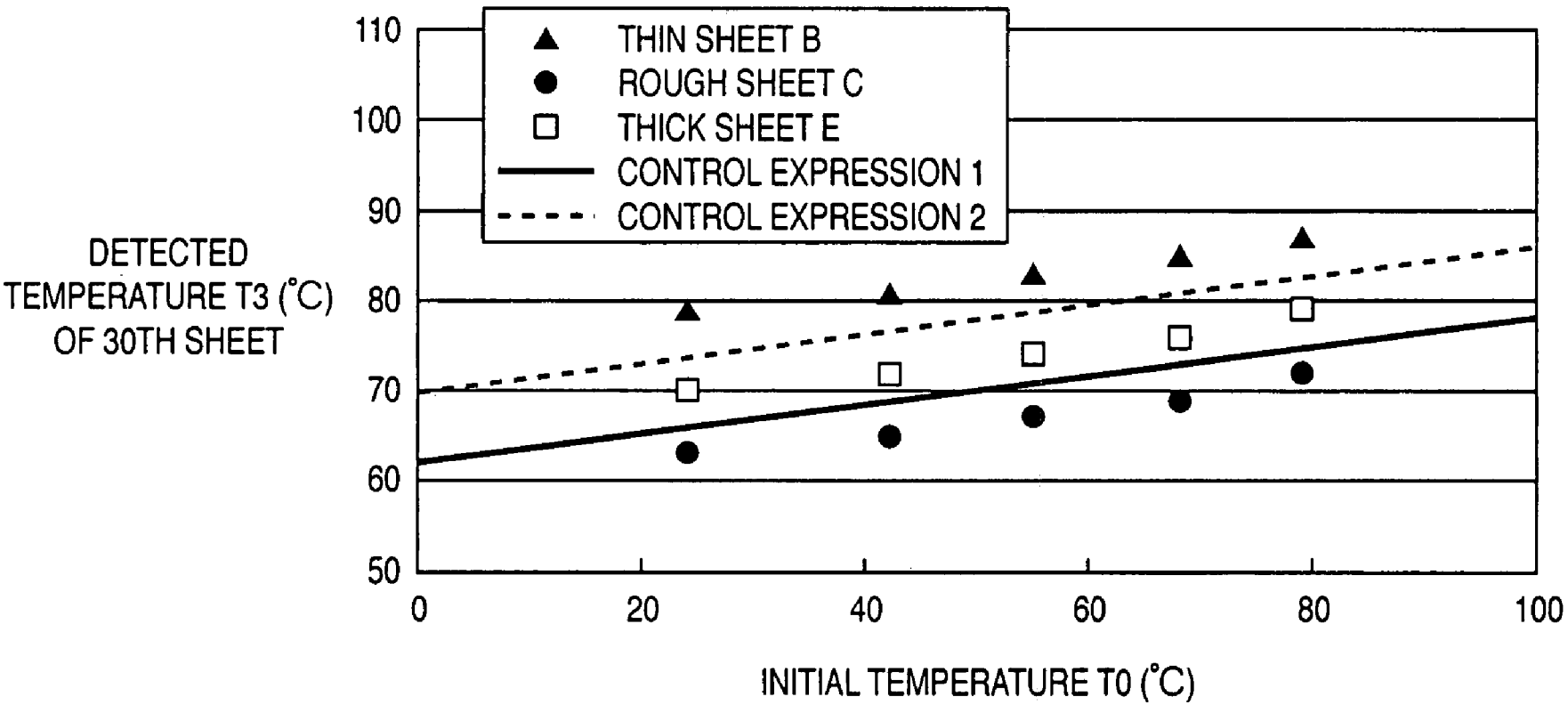
FIG. 12 is a graph showing the delivered sheet temperature of the 30th sheet of each printing material for each initial temperature in continuous printing operation.

FIG. 12 shows the results obtained when continuous printing was repeatedly performed from various initial temperatures T0 with respect to the thin sheets B, the rough sheets C, and thick sheets E each having a basis weight of 105 g/m$^2$ and smooth surface properties, and a temperature T3 was measured at the 30th sheet in continuous printing operation corresponding to each initial temperature T0. In this case, the initial temperature T0 is the temperature measured by the delivered sheet temperature sensor 32 immediately before the laser beam printer starts image forming operation including paper feeding, rotating/driving each unit, and the like upon receiving a print signal. As is obvious from FIG. 12, the detected temperatures of the 30th sheets of the respective types of printing materials in continuous printing operation change depending on the initial temperatures T0, and the higher the initial temperatures T0, the higher the detected temperatures of the 30th sheets in continuous printing operation. In addition, when the initial temperatures T0 are the same, the detected temperature of the 30th sheet of the thin sheets B in continuous printing operation is different from that of the thick sheets E, and so is between the thick sheets E and the rough sheets C. It is therefore obvious that the types of printing materials having undergone continuous printing can be discriminated by drawing boundary lines (control expressions 1 and 2) between the detected temperatures.

The amount of heat to be supplied to each printing material can be controlled by, for example, performing temperature control on the thermal fixing device or feeding back information for the printing material supply timing of the image forming apparatus on the basis of this discrimination result.

In this embodiment, an operation sequence based on the delivered sheet temperature sensor 32 is executed on the basis of the above experimental results. FIG. 9 is a flowchart showing operation in continuous printing by the image forming apparatus according to this embodiment.

Upon receiving a print signal (step S101), the image forming apparatus causes the delivered sheet temperature sensor 32 to measure the initial temperature T0 before starting printing operation (step S102).

The initial temperature T0 is then substituted into two control expressions determined in advance on the basis of experimental results like those shown in FIG. 12 to determine threshold temperatures T1 and T2 (step S103). For example, the threshold temperatures T1 and T2 are expressed by $$T1=0.16\cdot T0+62\ [^\circ\ \mathrm{C.}]$$

$$T2=0.16\cdot T0+70\ [^\circ\ \mathrm{C.}]$$

Subsequently, the image forming apparatus starts paper feeding operation for a printing material from the paper feeding device, image forming operation in the image forming unit, and energization of the heater of the thermal fixing device, and keeps the delivered sheet temperature sensor 32 monitoring the temperature of the printing material (step S104).

For example, the detected temperature T3 of the 30th sheet in continuous printing operation by the delivered sheet temperature sensor 32 is measured (step S105). Although, in this case, the detected temperature of the 30th sheet in continuous printing operation by the delivered sheet temperature sensor 32 is measured, a detected temperature at another time point may be measured.

Note that step 103 may be executed after step S104 or S105.

It is then determined whether or not the delivered sheet temperature T3 is equal to or higher than T2 (step S106). If the delivered sheet temperature T3 is equal to or higher than T2, it is determined that the temperature detected by the delivered sheet temperature sensor 32 is sufficiently high, and a thin sheet having a smooth surface as a printing material is heated/fused. As a result, the temperature of the heater of the thermal fixing device is lowered to a predetermined temperature (e.g., 5° C.) while the throughput (the number of printing materials conveyed within a predetermined period of time) is maintained, thereby preventing printing materials from being excessively heated (step S107).

If it is determined in step S106 that the delivered sheet temperature T3 is lower than T2, it is determined whether or not T3 is equal to or higher than T1 (step S108). If T3 is equal to or higher than T1 (i.e., $T1 \leqq T3 < T2$), it is determined that optimal thermal fixing operation is executed, and hence the printing operation is continued while the current throughput and temperature control are maintained (step S109).

If it is determined in step S108 that the delivered sheet temperature T3 is lower than T1, it indicates that the printing material is not sufficiently heated, and the fusing performance may be degraded. Therefore, the throughput is decreased by increasing the sheet interval (step S110). For example, the throughput is decreased in accordance with a table describing the relationship between the number of sheets printed and the throughput like that shown in FIG. 13. Referring to FIG. 13, "ppm" is the unit of throughput, which indicates the number of sheets printed per min. Note that the method of satisfying the requirement for fusing performance by decreasing the throughput has been described above. In this method, the amount of heat supplied to a printing material is increased by additionally supplying heat from the pressurizing roller side as well by increasing the sheet interval and sufficiently heating the pressurizing roller in the interval. However, it suffices to use another method of increasing the amount of heat supplied to a printing material by, for example, increasing the controlled temperature of the heater.

With the above operation, the amount of heat supplied to a printing material is automatically controlled in accordance with the type of printing material conveyed on the basis of the temperature detected by the delivered sheet temperature sensor 32, and printing operation is continued up to the last page (steps S111 and S112). After the last page is subjected to thermal fixing operation, the printing operation is terminated, and the set thresholds T1 and T2 are cleared (step S113).

In order to confirm the effects of this embodiment described above, comparative experiments were conducted in a case wherein the heating conditions were not changed at all (comparative example 1), and in a case wherein threshold temperatures T1 and T2 were respectively set to constant temperatures of 70° C. and 77° C. regardless of the initial temperature T0 (comparative example 2). In this embodiment, comparative example 1, and comparative example 2, continuous printing was performed, and the stacking capacities of paper delivery trays (250 sheets according to the specifications) and fusing performances were compared with each other. To test the tacking capacity of each paper delivery tray, the number of printing materials which could be stacked on the tray was counted until a printing material fell down. Fusing performance was determined on the basis of how much image was stripped off from the printed surface of a printing material after printing operation when a tape was stuck on the printed surface and peeled off.

The printed printing materials were the above thin sheet B, rough sheet C, and thick sheet E. An experiment was executed five times for each type of sheet under each of conditions: initial temperatures of 23° C., 50° C., and 70° C. by delivered sheet temperature sensor 32 before printing operation. The number of sheets stacked was the mean value obtained in the five experiments. The fusing performance was determined as "○" when no problem occurred in all the five experiments; "Δ" when image loss occurred two or less times; and "X" when image loss occurred three or more times. FIGS. 14A to 14C show comparison results.

Referring to FIG. 14A, with regard to the thin sheet B, this embodiment in which the amount of heat supplied to properly determined printing materials was controlled exhibits satisfactory stacking capacities without degrading fusing performance. In contrast, comparative example 1 in which temperature control on the heater by the delivered sheet temperature sensor 32 was not performed is inferior in stacking capacities. This is because, printing materials with large curls are stacked on the paper delivery tray, and a succeeding printing material pushes an already stacked printing material from the paper delivery tray to make it fall down from the tray. In comparative example 2 in which a threshold temperature was kept constant regardless of the initial temperature T0, although thin sheets could be correctly identified at initial temperatures of 50° C. and 70° C., a thin sheet could not sometimes be identified at an initial temperature of 23° C. As a result, temperature control feedback was not performed for the heater three times in the five tests, and hence the stacking capacity sometimes decreased as in comparative example 1.

FIG. 14B shows the results obtained when the rough sheets C were subjected to continuous printing. In this embodiment, fusing failure could be avoided by decreasing the throughput in accordance with the number of sheets printed on the basis of a table like that shown in FIG. 13. In comparative example 1, however, fusing failure occurred in the 40th and subsequent sheets. In comparative example 2 as well, a rough sheet could not identified two times in the five tests, and fusing failure occurred.

FIG. 14C shows the results obtained when the thick sheets E were subjected to continuous printing. In this embodiment and comparative example 1, since no changes were made to temperature control on the heater and the throughput, large stacking capacities and good fusing performances could be obtained. In contrast, in comparative example 2, the throughput was decreased to improve fusing performance at an initial temperature of 23° C., and the temperature of the heater was lowered by 5° C. at an initial temperature of 70° C. In either of the cases, therefore, a decrease in stacking capacity and a deterioration in fusing performance occurred sometimes.

As described above, according to this embodiment, the delivered sheet temperature sensor 32 with a small heat capacity is placed on the unprinted surface side next to the fusing nip, and the threshold T1 was set in accordance with the initial temperature T0 at the start of printing operation. In addition, the delivered sheet temperature T3 is measured at a predetermined time point in continuous printing operation, and fusing control is performed in accordance with the result of comparison between T3, T1, and T2. This makes it possible to prevent problems such as hot offset, curl/stacking failure, and fusing failure.

According to this embodiment described above, the type of printing material can be substantially discriminated on the basis of the result of comparing the thresholds T1 and T2 set in accordance with the initial temperature T0 at the start of printing with the delivered sheet temperature T3 at a predetermined time point in continuous printing operation. The object of the present invention is not necessarily to discriminate the type of printing material, but to execute optimal thermal fixing operation by changing the amount of heat supplied to a printing material in accordance with the initial temperature detected by the delivered sheet temperature sensor 32 at the start of printing and the subsequent transition of detected temperatures. The present invention is not therefore limited to any specific detection timing, amount-of-heat control method, and the like as long as a method of controlling the amount of heat supplied to a printing material on the basis of the degree of temperature change (the gradient of detected temperatures) of the initial temperature T0 detected by the delivered sheet temperature sensor 32 and the temperatures subsequently detected by the delivered sheet temperature sensor 32 is realized.

This embodiment has exemplified the method of measuring the initial temperature T0 at the start of printing by using the delivered sheet temperature sensor 32. Although the initial temperature T0 measured by the delivered sheet temperature sensor 32 corresponds to the ambient temperature near the fusing device, the initial temperature T0 corresponding to the ambient temperature may be measured by another temperature detection element placed near the thermal fixing device in place of the delivered sheet temperature sensor 32. Alternatively, the initial temperature T0 may be measured by the thermistor 23*a* serving as a heater temperature detection element. Although the thermistor 23*a* is directed to measure the temperature of the heater 23, since this temperature is greatly influenced by the above ambient temperature, it is obvious that the object of the present invention can be achieved by this operation.

<Second Embodiment>

Figure 15:
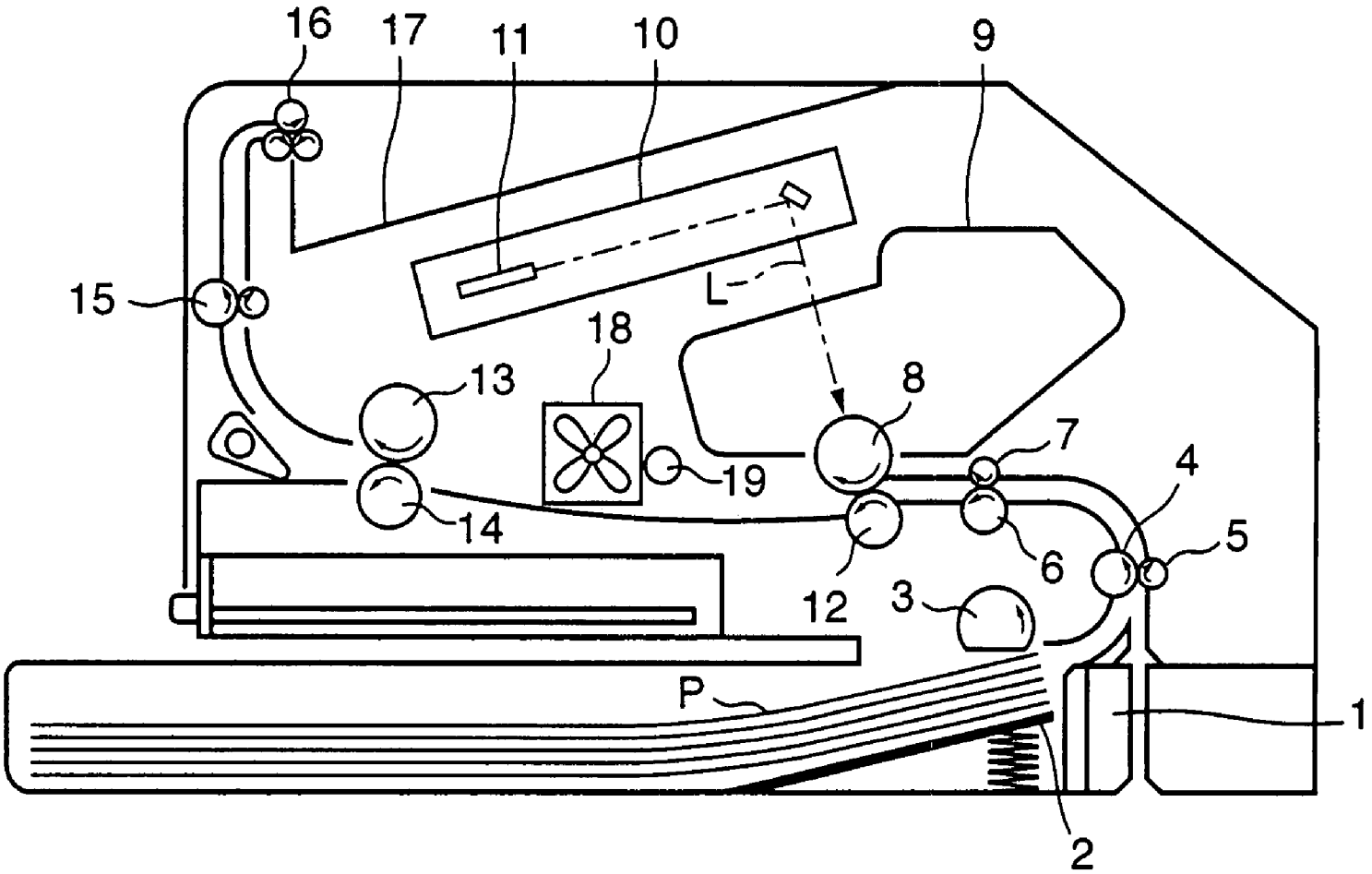
FIG. 15 is a schematic sectional view of an image forming apparatus according to the second embodiment of the present invention.

FIG. 15 shows the arrangement of an image forming apparatus according to the second embodiment. The same reference numerals as in FIG. 1 denote the same constituent elements in FIG. 15, and hence a description thereof will be omitted. In addition, since the arrangement of a thermal fixing device in this embodiment is the same as that in the first embodiment, the thermal fixing device will be described by referring to FIGS. 2 to 8.

In this embodiment, an outside air temperature sensor 19 such as a thermistor for detecting an environment (room temperature) in which an image forming apparatus is installed is placed on, for example, a side surface of the apparatus body. The outside air temperature sensor 19 is placed near a cooling fan 18, which prevents a rise in temperature inside the apparatus by taking outside air in the apparatus, so as to accurately detect a temperature outside the apparatus. This makes it possible for the outside air temperature sensor 19 to accurately detect room temperature at which the image forming apparatus is installed.

This embodiment proposes a method of more accurately discriminating the type of printing material by the delivered sheet temperature sensor 32 in the first embodiment in accordance with the environment in which the image forming apparatus is used.

Figure 17:
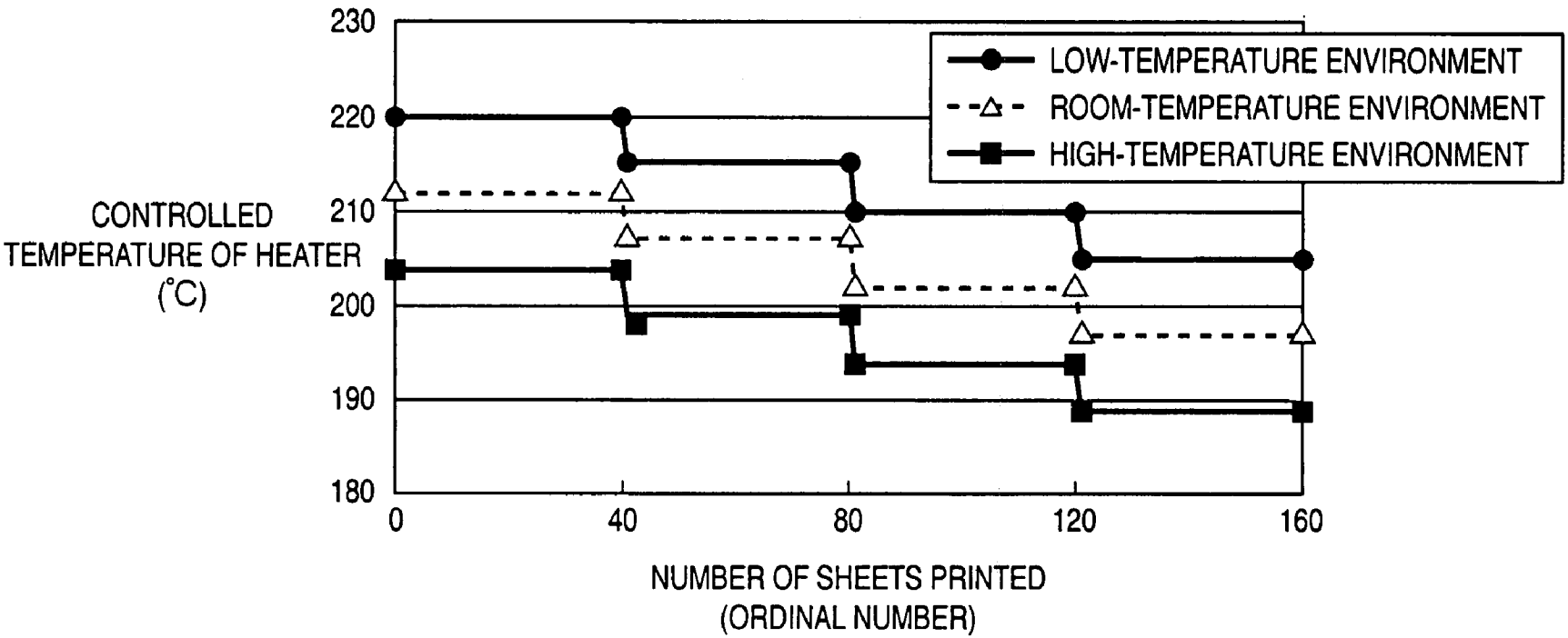
FIG. 17 is a graph showing an example of temperature control performed on a heater in accordance with the environmental temperature.

A control method using a delivered sheet temperature sensor according to this embodiment will be described below. In general, the temperature of printing materials stacked on a paper feed tray is kept at a temperature near the temperature in the environment in which the image forming apparatus is installed, although it depends on the environment. Depending on the environments in which image forming apparatuses are installed, even if the thermal fixing devices generate heat in the same manner, the temperatures around the thermal fixing devices differ from each other due to the influences of convection and the like. Even if, therefore, optimal thermal fixing operation is executed, the temperature detected by the delivered sheet temperature sensor changes depending on whether the temperature in the environment in which the image forming apparatus is installed is low or high. In addition, a thermal fixing device based on the film heating method, in particular, uses a method of finely controlling the temperature of the heater in accordance with the environment in which the image forming apparatus is installed and the number of sheets continuously printed, because films with a small heat capacity are used. FIG. 17 shows a specific example of this temperature control. Referring to FIG. 17, the abscissa represents the number of sheets continuously printed from an early-morning state; and the ordinate, the controlled temperature of the heater.

As shown in FIG. 17, when the image forming apparatus is installed in a high-temperature environment (e.g., a room temperature of 30° C. or higher), since the temperature of printing materials in the paper feed tray has reached near the environmental temperature, sufficient fusing performance can be obtained even if the amount of heat supplied to a printing material is suppressed to a small amount in the thermal fixing device. On the other hand, the controlled temperature of the heater is determined, depending on whether the apparatus is installed in a room-temperature environment (e.g., a room temperature of 20° C. to 30° C.) or a low-temperature environment (e.g., a room temperature of 20° C. or lower), in consideration of the temperature of printing materials in the paper feed tray in each environment. By setting a higher controlled temperature for the heater with a decrease in temperature in the encryption in which the apparatus is installed, constant fusing performance can be obtained regardless of the environment.

Referring to FIG. 17, the reason why the controlled temperature of the heater is gradually lowered in accordance with the number of sheets printed is to maintain the amount of heat supplied to printing materials constant. More specifically, in continuous printing operation, the temperatures of various heating members and the pressurizing roller arranged around the heater gradually rise in a sheet interval and the like. For this reason, for example, in a state wherein the pressurizing roller is sufficiently heated, heat is also supplied from the unprinted surface side to a printing material and contributes to heating a toner image on the printing material. Even if, therefore, the controlled temperature of the heater is gradually lowered, sufficient fusing performance can be obtained.

As described above, the film heating method, in particular, uses the method of optimizing the controlled temperature of the heater in accordance with the environment in which the image forming apparatus is installed. The identification of a printing material by the delivered sheet temperature sensor and the optimal value to be fed back for control on the amount of heat supplied to the printing material in accordance with the identification result change depending on the environment in which the image forming apparatus is installed.

Figure 18A:
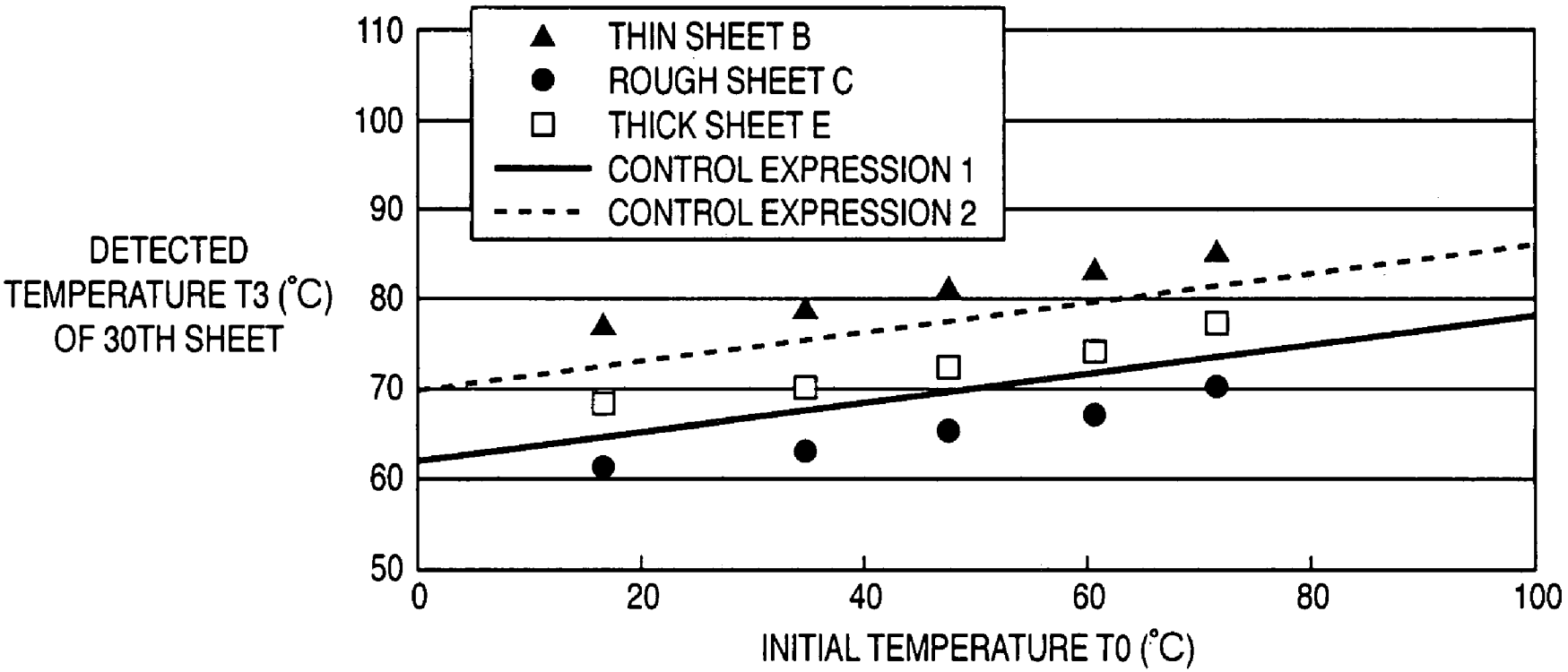
FIG. 18A is a graph showing the delivered sheet temperature of the 30th sheet of each printing material for each initial temperature in continuous printing operation at an environmental temperature of 15° C.
Figure 18B:
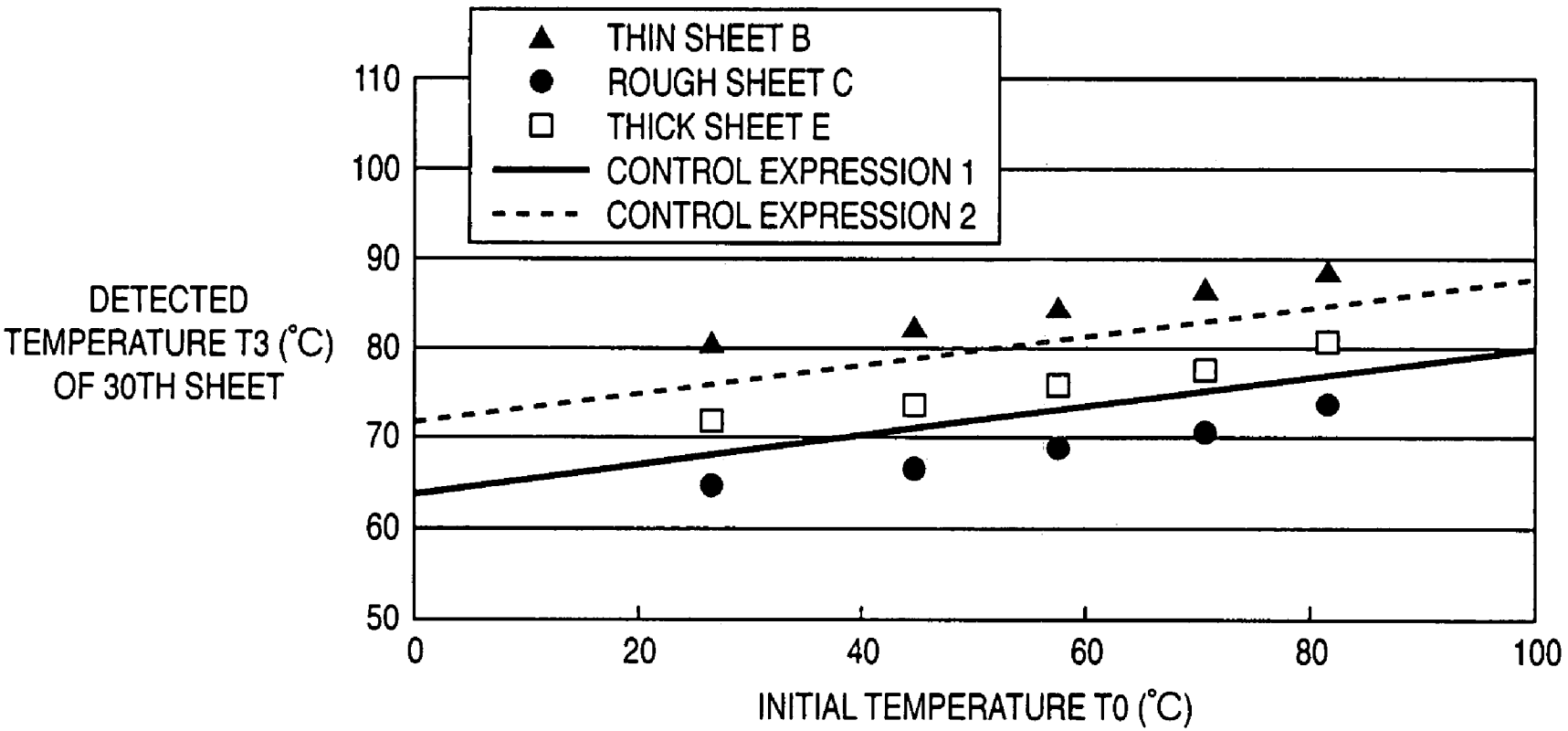
FIG. 18B is a graph showing the delivered sheet temperature of the 30th sheet of each printing material for each initial temperature in continuous printing operation at an environmental temperature of 25° C.
Figure 18C:
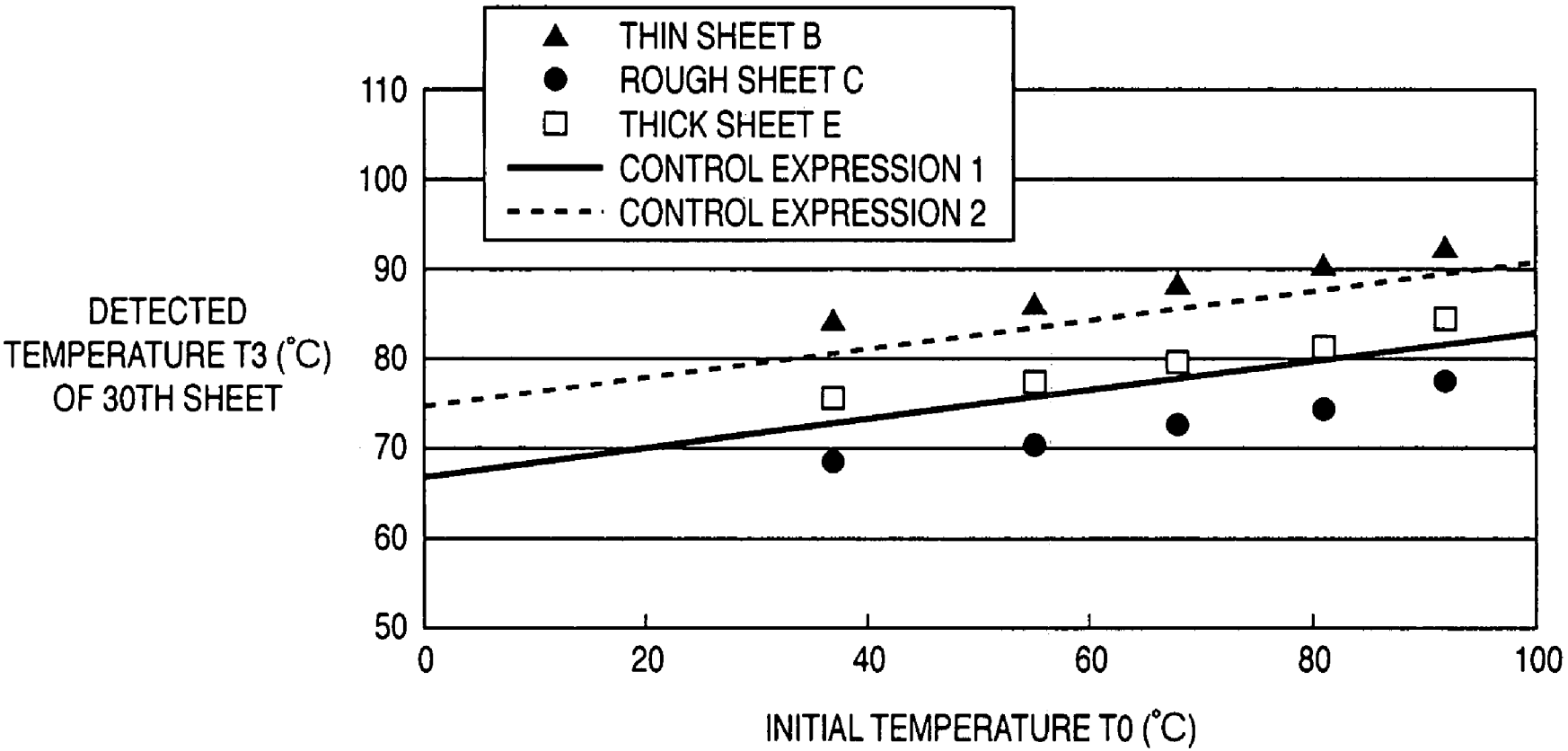
FIG. 18C is a graph showing the delivered sheet temperature of the 30th sheet of each printing material for each initial temperature in continuous printing operation at an environmental temperature of 35° C.
Figure 19:
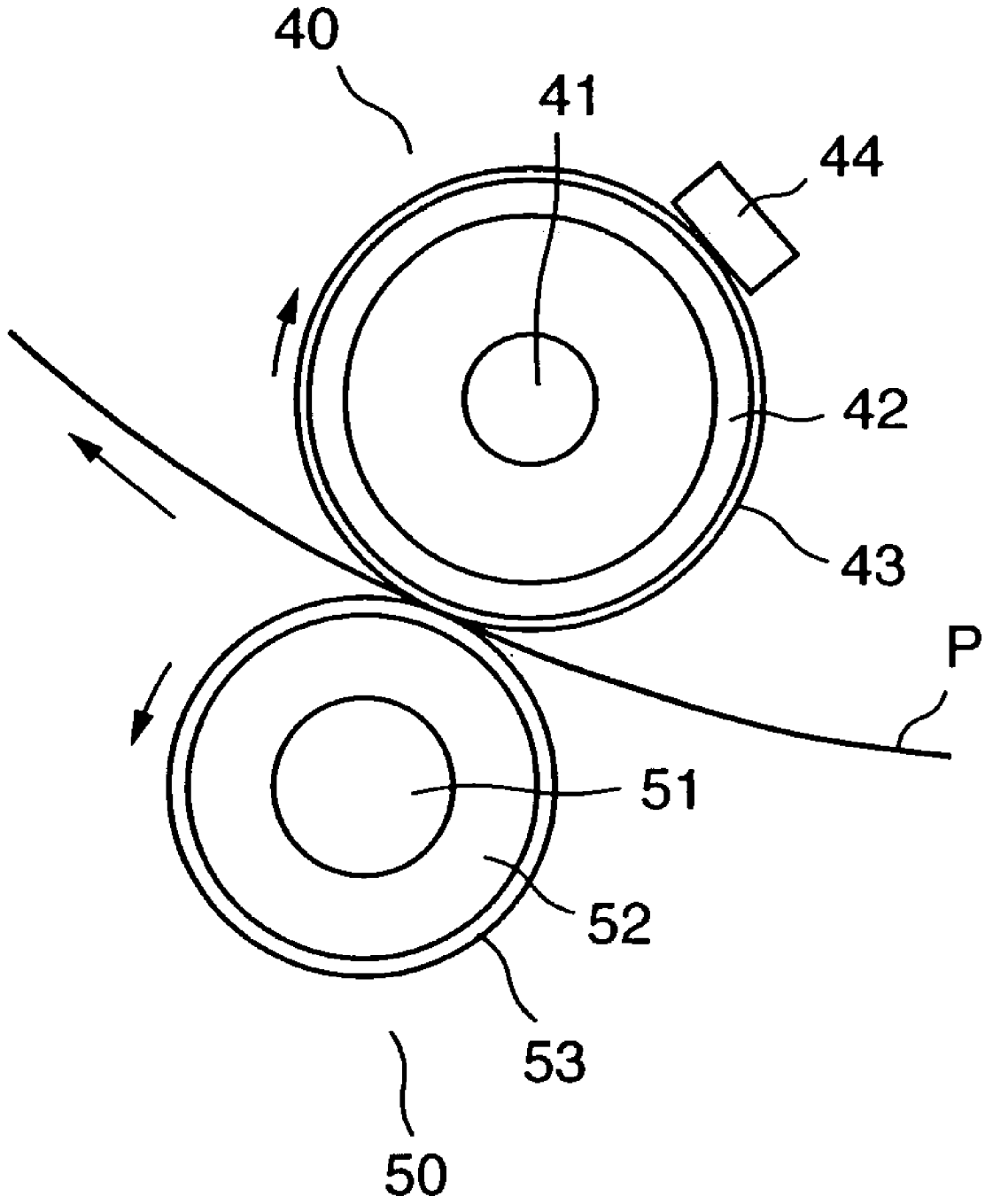
FIG. 19 is a view showing the arrangement of a thermal fixing device based on a conventional heating roller fusing system.
Figure 20:
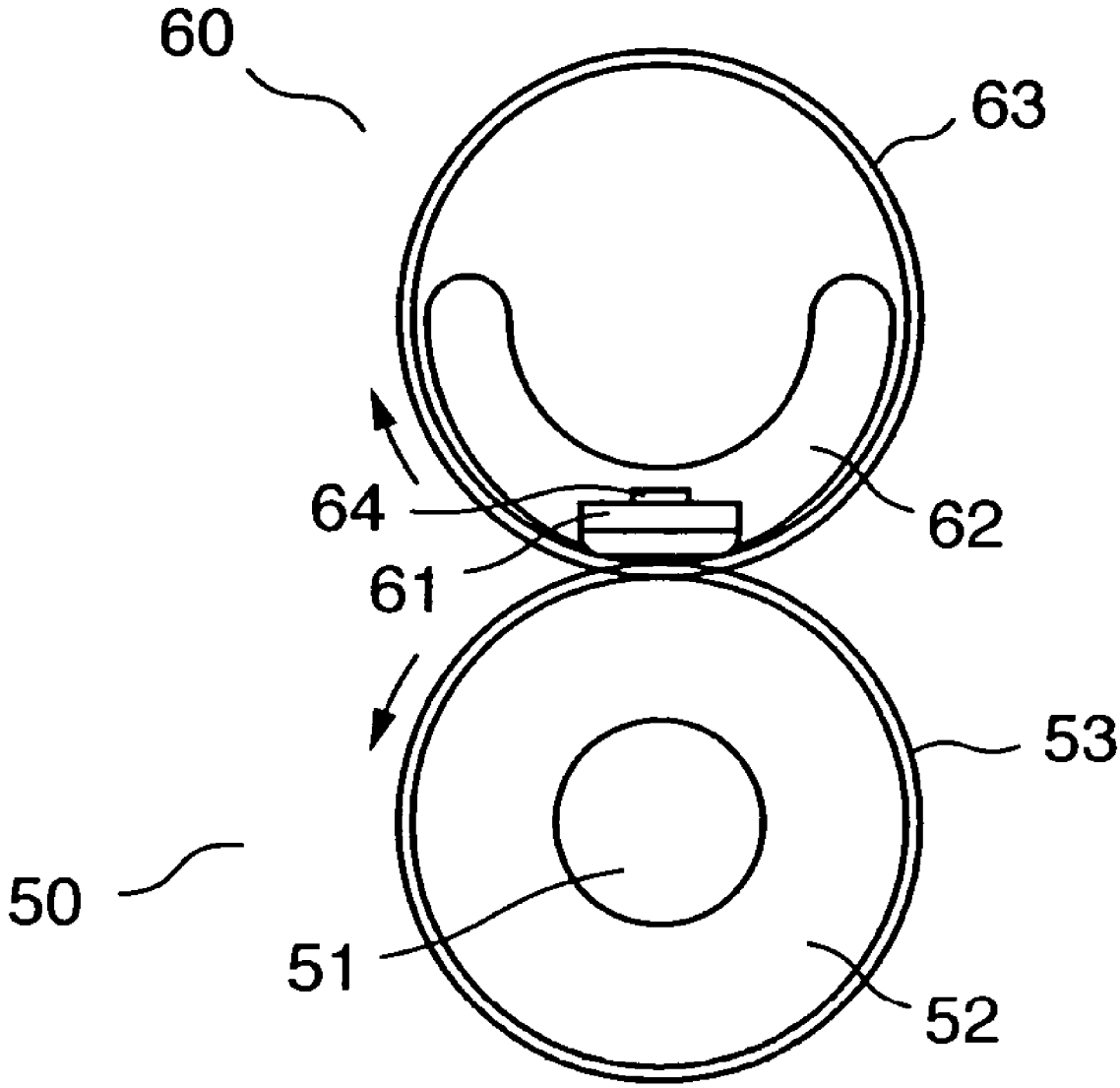
FIG. 20 is a view showing the arrangement of a thermal fixing device based on a conventional film heating method.
Figure 21:
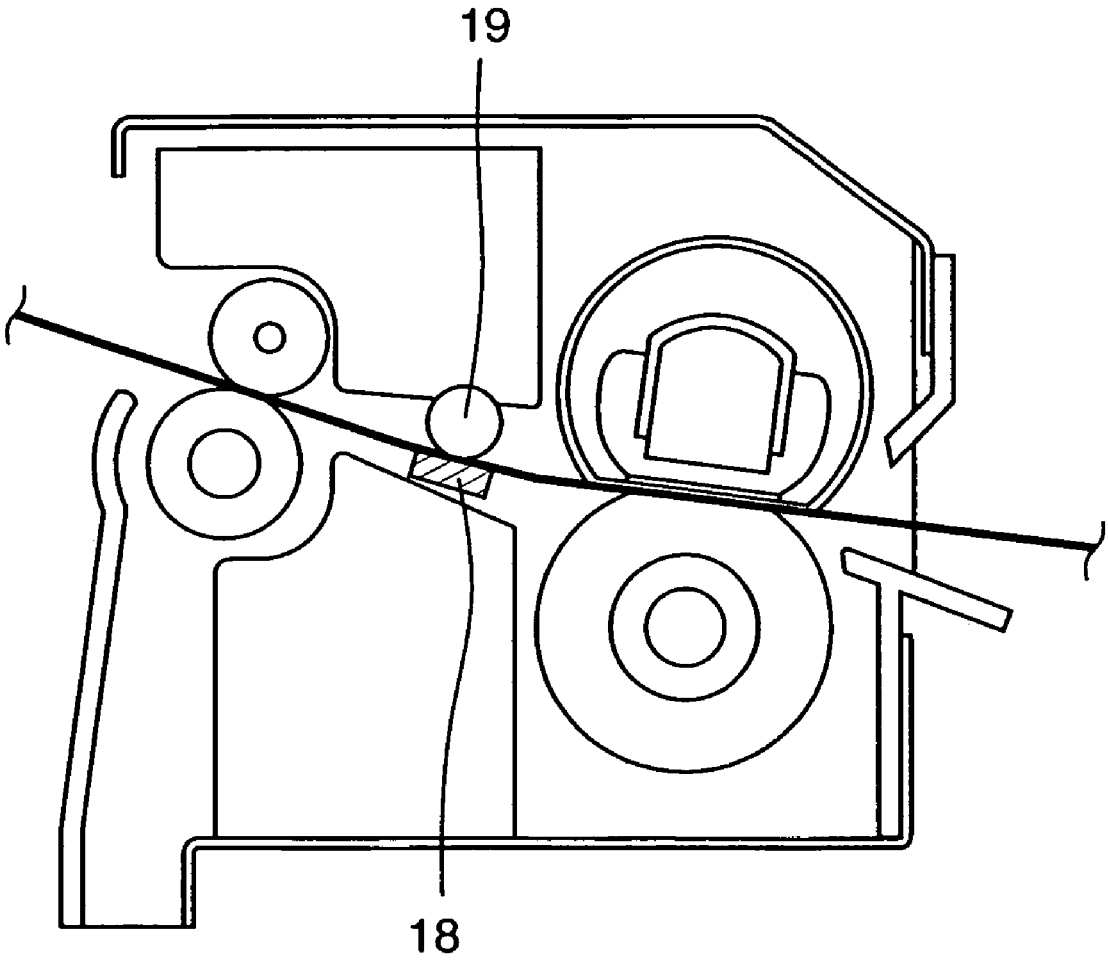
FIG. 21 is a view showing a conventional thermal fixing device which performs temperature detection by using a contact type sensor.
Figure 22:
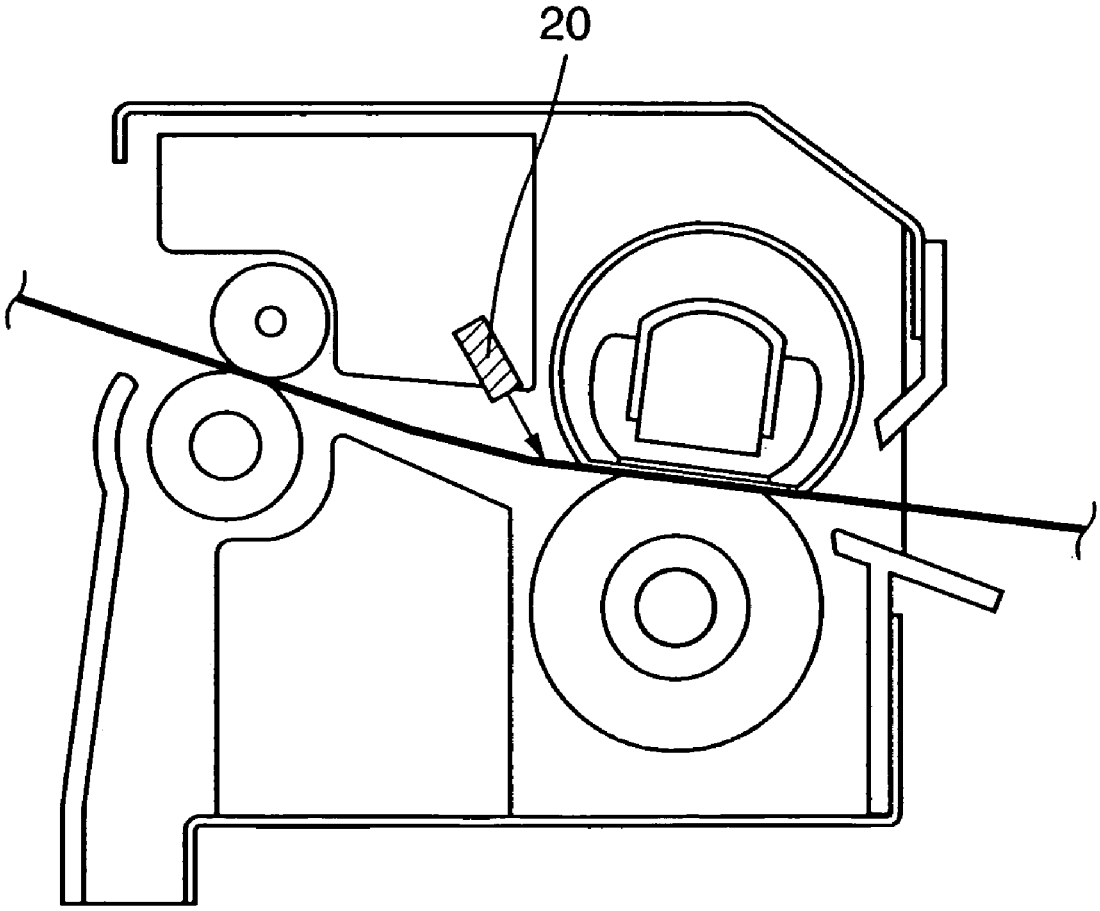
FIG. 22 is a view showing an example of a conventional thermal fixing device which performs temperature detection by using a non-contact type sensor.

For this reason, an experiment was conducted to check how the temperature detected at the 30th sheet of each printing material in continuous printing operation changed in each environment in accordance with an initial temperature T0 detected by the delivered sheet temperature sensor at the start of printing. The environmental temperatures at which image forming apparatuses were installed were room temperatures of 15° C., 25° C., and 35° C. The printing materials used in this experiment were a thin sheet B, rough sheet C, and thick sheet E as in the first embodiment. FIGS. 18A to 18C show the results of detecting temperatures by using a delivered sheet temperature sensor 32. As is obvious from these results, even if the initial temperature T0 is the same, the temperature detected by the delivered sheet temperature sensor 32 at the 30th sheet in continuous printing operation slightly changes depending on the environment in which the image forming apparatus is installed.

It can be said from the above that the identification accuracy can be improved by changing control expressions 1 and 2 for discriminating the type of printing material in accordance with each environmental temperature.

Therefore, there will be described a method of changing a control sequence for controlling printing material identification by the delivered sheet temperature sensor and the amount of heat supplied to a printing material, in accordance with the environmental temperature at which the image forming apparatus is installed.

FIG. 16 is a flowchart showing operation in continuous printing by the image forming apparatus according to this embodiment.

Upon receiving a print signal (step S201), the image forming apparatus causes the outside air temperature sensor 19 to measure a temperature Te in the environment in which the image forming apparatus is installed, and determines a controlled temperature profile for the heater on the basis of the measurement result (step S202). The image forming apparatus then sequentially executes energization of the heater, the start of image forming operation, and thermal fixing of an unfixed image on a printing material (step S203).

Subsequently, the image forming apparatus causes the delivered sheet temperature sensor 32 to measure the initial temperature T0 a predetermined time after the start of the energization of the heater (step S204). In the first embodiment, the initial temperature T0 is measured by the delivered sheet temperature sensor 32 before the energization of the heater. However, as in this embodiment, the temperature detected by the delivered sheet temperature sensor 32 a predetermined time after the start of the energization of the heater may be set as the initial temperature T0. In this case, since the thermal fixing device is rotated/driven, the temperature detected by the delivered sheet temperature sensor 32 is slightly higher than that detected before the energization of the heater. However, since this detected temperature is influenced by how much the thermal fixing device is heated, the delivered sheet temperature sensor 32 detects a temperature influenced by both the ambient temperature next to the fusing nip and the heated state of the thermal fixing device. A method of measuring the initial temperature T0 is not limited to the above method, and the detection timing is not specifically limited as long as a method capable of detecting how much the thermal fixing device is heated is used.

Subsequently, threshold temperatures T1 and T2 are determined on the basis of both the initial temperature T0 and the detected environmental temperature Te (step S205). For example, the threshold temperatures T1 and T2 are given by $$T1=0.25\cdot Te+0.16\cdot T0+57.75\ [^\circ\ \mathrm{C.}]$$

$$T2=0.25\cdot Te+0.16\cdot T0+65.75\ [^\circ\ \mathrm{C.}]$$

Subsequently, continuous printing is continued, and a detected temperature T3 by the delivered sheet temperature sensor 32 at, for example, the 30th sheet is measured (step S206). Note that step S105 may be executed after step S206. The subsequent processing is the same as that after step S106 in the first embodiment. This processing will be described below.

It is determined whether or not the delivered sheet temperature T3 is equal to or higher than T2 (step S207). If the delivered sheet temperature T3 is equal to or higher than T2, it is determined that the temperature detected by the delivered sheet temperature sensor 32 is sufficiently high, and a thin sheet having a smooth surface as a printing material is heated/fused. As a result, the temperature of the heater of the thermal fixing device is lowered to a predetermined temperature (e.g., 5° C.) while the throughput (the number of printing materials conveyed within a predetermined period of time) is maintained, thereby preventing printing materials from being excessively heated (step S208).

If it is determined in step S207 that the delivered sheet temperature T3 is lower than T2, it is determined whether or not T3 is equal to or higher than T1 (step S209). If T3 is equal to or higher than T1 (i.e., T1≦T3<T2), it is determined that optimal thermal fixing operation is executed, and hence the printing operation is continued while the current throughput and temperature control are maintained (step S210).

If it is determined in step S209 that the delivered sheet temperature T3 is lower than T1, it indicates that the printing material is not sufficiently heated, and the fusing performance may be degraded. Therefore, the throughput is decreased by increasing the sheet interval (step S211).

With the above processing, printing operation is continued up to the last page while the amount of heat supplied to a printing material is automatically controlled in accordance with the type of printing material conveyed on the basis of the temperature detected by the delivered sheet temperature sensor 32 (steps S212 and S213). After thermal fixing is performed for the last page, the printing operation is terminated, and the set thresholds T1 and T2 are cleared (step S214).

In this embodiment and the first embodiment, the temperature T3 detected by the delivered sheet temperature sensor 32 at the 30th sheet in continuous printing operation is compared with the threshold temperatures T1 and T2 to change the amount of heat to be subsequently supplied to printing materials. However, the temperature T3 may be detected at any timing in continuous printing operation and fed back. For example, each embodiment may use a method of determining threshold temperatures T1 and T2 in an interval between the 20th sheet and the 35th sheet in continuous printing operation in accordance with the corresponding number of sheets printed on the basis of the initial temperature T0 and environmental temperature Te, and sequentially performing determination. Each embodiment may also use a method of determining the highest temperature or average temperature in an interval between the 20th sheet and the 35th sheet as T3.

This embodiment has exemplified the method of detecting the temperature Te in the environment in which the image forming apparatus is installed and determining the threshold temperatures T1 and T2 on the basis of the resultant information. It is, however, known that the moisture contained in a printing material influences curl and fusing performance. It is, therefore, conceivable that the accuracy of identifying the type of printing material can be improved by providing the image forming apparatus with an element which detects an environmental humidity and using a method of determining the threshold temperatures T1 and T2 on the basis of the information obtained by the element.

In order to confirm the effects of this embodiment, thermal fixing was performed for various types of printing materials in the image forming apparatus and thermal fixing device according to the first embodiment by using only the control sequence for a 25° C. environment under various environments (15° C., 25° C., and 35° C. environments) (comparative example), and the frequencies of occurrence of hot offset, the stacking capacities on the paper delivery tray, and fusing performances were compared. As a result, the method of determining threshold temperatures on the basis of environmental temperatures as in this embodiment exhibited higher printing material identification accuracy and further reduced the occurrence of inconveniences.

As described above, this embodiment further includes the means for detecting a temperature and/or humidity in the environment in which the apparatus is installed, in addition to the arrangement of the first embodiment, and determines thresholds for discriminating a printing material on the basis of the detection result obtained by the means and the detection result on the initial temperature detected by the delivered sheet temperature sensor. Therefore, a printing material can be accurately identified and the amount of heat supplied to the printing material can be accurately controlled regardless of the environment in which the image forming apparatus is used or the heated state of the thermal fixing device. This makes it possible to prevent the problems of curl/packing capacity reduction, hot offset, and fusing failure regardless of the type of printing material, and to heat/fuse an unfused image on a printing material with good quality.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-054638 filed Feb. 27, 2004, which is hereby incorporated by reference herein.

What is claimed is:

1. An image forming apparatus comprising:

an image forming unit configured to form a toner image on a printing material;

a thermal fixing unit configured to have a rotating member incorporating a heating element and a pressurizing member which comes into contact with the rotating member and pressurizes the rotating member, convey a printing material on which a toner image is formed to a nip area between the rotating member and the pressurizing member, and fuse the toner image on the printing material by making the printing material pass through the nip area while applying heat from the heating element to the printing material;

a temperature sensor configured to detect a temperature of the printing material which has passed through the nip area, wherein said temperature sensor is capable of detecting a temperature near said thermal fixing unit when the printing material does not pass through said thermal fixing unit; and a control unit configured to, when continuous printing operation is performed in which a plurality of printing materials are printed continuously, control an amount of heat supplied to a succeeding printing material on the basis of a first temperature detected by said temperature near said thermal fixing unit sensor at a time point before a first printing material is conveyed to the nip area in the continuous printing operation and a second temperature of the printing material that has passed through the nip area, detected by said temperature sensor at a predetermined time point during the continuous printing operation.

2. The apparatus according to claim 1, wherein said control unit includes:

a unit configured to set a threshold for the second temperature on the basis of the first temperature; and a unit configured to determine a controlled variable for an amount of heat supplied to the succeeding printing material in accordance with a comparison result between the set threshold and the second temperature.

3. The apparatus according to claim 2, wherein the controlled variable comprises at least one of a throughput indicating the number of sheets printed per unit time and a temperature of the heating element.

4. The apparatus according to claim 1, further comprising a paper delivery sensor unit configured to detect the presence/absence of a printing material passing through said thermal fixing unit, wherein said temperature sensor is provided in said paper delivery sensor unit.

5. The apparatus according to claim 4, wherein said paper delivery sensor unit includes a sensor lever which comes into contact with a conveyed printing material and is made to pivot as the printing material is conveyed, and said temperature sensor is mounted on the sensor lever.

6. The apparatus according to claim 5, wherein the sensor lever is provided on an unprinted surface side of a printing material.

7. The apparatus according to claim 1, further comprising an ambient temperature sensor configured to detect an ambient temperature near said thermal fixing unit, wherein said control unit detects the second temperature at the predetermined time point by using said ambient temperature sensor in place of said temperature sensor.

8. The apparatus according to claim 1, further comprising an outside air measuring unit configured to measure at least one of an outside air temperature and a humidity, wherein said control unit further controls the amount of heat supplied to the succeeding printing material on the basis of a measurement result obtained by said outside air measuring unit before the continuous printing operation.

9. The apparatus according to claim 8, wherein said control unit includes:

a unit configured to set a threshold for the second temperature on the basis of a measurement result obtained by said outside air measuring unit and the first temperature; and a unit configured to determine a controlled variable for the amount of heat supplied to the succeeding printing material in accordance with a comparison result between the set threshold and the second temperature.

10. A control method for an image forming apparatus including an image forming unit configured to form a toner image on a printing material, and a thermal fixing unit configured to have a rotating member incorporating a heating element and a pressurizing member which comes into contact with the rotating member and pressurizes the rotating member, convey a printing material on which a toner image is formed to a nip area between the rotating member and the pressurizing member, and fuse the toner image on the printing material by making the printing material pass through the nip area while applying heat from the heating element to the printing material, comprising:

a first measuring step of, when continuous printing operation in which a plurality of printing materials are printed continuously is performed, measuring a first temperature indicating an ambient temperature near the thermal fixing unit at a time point when the printing material does not pass through the thermal fixing unit in the continuous printing operation;

a second measuring step of measuring a second temperature indicating a temperature of the printing material which has passed through the nip area at a predetermined time point during the continuous printing operation; and a control step of controlling in the continuous printing operation an amount of heat supplied to the succeeding printing material on the basis of the first temperature near the thermal fixing unit at a time point before a first printing material is conveyed to the nip area and the second temperature of the printing material that has passed through the nip area, respectively measured in the first measuring step and the second measuring step.

11. The method according to claim 10, wherein the control step includes:

a step of setting a threshold for the second temperature on the basis of the first temperature; and a step of determining a controlled variable for the amount of heat supplied to the succeeding printing material in accordance with a comparison result between the set threshold and the second temperature.

12. The method according to claim 11, wherein the controlled variable comprises at least one of a throughput indicating the number of sheets printed per unit time and a temperature of the heating element.

13. The method according to claim 10, further comprising an outside air measuring step of measuring at least one of an outside air temperature and a humidity before the continuous printing operation, wherein in the control step, the amount of heat supplied to the succeeding printing material is controlled on the basis of a measurement result obtained in the outside air measuring step.

14. The method according to claim 13, wherein the control step includes:

a step of setting a threshold for the second temperature on the basis of a measurement result obtained in outside air measuring step and the first temperature; and a step of determining a controlled variable for the amount of heat supplied to the succeeding printing material in accordance with a comparison result between the set threshold and the second temperature.

* * * * *

UNITED STATES PATENT AND TRADEMARK OFFICE

CERTIFICATE OF CORRECTION

PATENT NO. : 7,187,878 B2
APPLICATION NO. : 11/060678
DATED : March 6, 2007
INVENTOR(S) : Satoru Izawa et al.

It is certified that error appears in the above-identified patent and that said Letters Patent is hereby corrected as shown below:

ON THE TITLE PAGE:
Item (56), References Cited, Foreign Patent Documents, "JP 7230231 A * 8/1995" should be deleted.

COLUMN 2:
Line 51, "is" should read --are--.

COLUMN 15:
Line 56, "103" should read --S103--.

COLUMN 17:
Line 31, "not" should read --not be--.

Signed and Sealed this

First Day of April, 2008

JON W. DUDAS
*Director of the United States Patent and Trademark Office*